US011965674B2

(12) United States Patent
Park et al.

(10) Patent No.: US 11,965,674 B2
(45) Date of Patent: Apr. 23, 2024

(54) FILTER DEVICE AND AIR CLEANER HAVING THE SAME

(71) Applicant: SAMSUNG ELECTRONICS CO., LTD., Suwon-si (KR)

(72) Inventors: Juwan Park, Suwon-si (KR); Nakhyun Kim, Suwon-si (KR); Juyoung Kim, Suwon-si (KR); Changhyun Park, Suwon-si (KR); Moonsun Shin, Suwon-si (KR); Wonhee Lee, Suwon-si (KR); Hojin Lee, Suwon-si (KR); Changwoo Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 348 days.

(21) Appl. No.: 17/235,340

(22) Filed: Apr. 20, 2021

(65) Prior Publication Data

US 2021/0325063 A1 Oct. 21, 2021

(30) Foreign Application Priority Data

Apr. 21, 2020 (KR) ..... 10-2020-0047951

(51) Int. Cl.

| | |
|---|---|
| ***F24F 8/10*** | (2021.01) |
| ***F24F 8/108*** | (2021.01) |
| ***F24F 13/20*** | (2006.01) |
| ***F24F 13/28*** | (2006.01) |

(52) U.S. Cl.

CPC ..... *F24F 8/108* (2021.01); *F24F 13/20* (2013.01); *F24F 13/28* (2013.01)

(58) Field of Classification Search

CPC .. F24F 8/108; F24F 13/20; F24F 13/28; F24F 8/80; B01D 39/16; B01D 46/0005; B01D 46/12; B01D 46/42

See application file for complete search history.

(56) References Cited

U.S. PATENT DOCUMENTS 2,580,310 A * 12/1951 Magnenat ..... E05F 1/1284 220/827
3,950,157 A * 4/1976 Matney ..... B01D 46/10 55/306
4,389,352 A * 6/1983 Bohanon, Sr. ..... F24F 6/04 261/106

(Continued)

FOREIGN PATENT DOCUMENTS

JP 2016-52370 A 4/2016
JP 2020-1039 A 1/2020

(Continued)

OTHER PUBLICATIONS

PCT International Search Report for PCT Application No. PCT/KR2021/003707 dated Jul. 27, 2021.

*Primary Examiner* — Stephen Hobson

(74) *Attorney, Agent, or Firm* — STAAS & HALSEY LLP

(57) ABSTRACT

An air purifier or air conditioner including a filter device. The air purifier includes: a main body: a suction port provided to allow air to flow into the main body; a filter provided in the main body to filter the air suctioned from the suction port and including a frame and a filter body fixed to the frame; an auxiliary filter member separably mounted on the filter; and a locking device provided on the frame of the filter such that the auxiliary filter member is separably mounted on the frame of the filter.

14 Claims, 25 Drawing Sheets

(56) References Cited

U.S. PATENT DOCUMENTS 4,409,706 A * 10/1983 Clendinen ..... F16B 21/06 24/662
4,644,614 A * 2/1987 Mizusawa ..... H05K 7/142 24/297
4,701,196 A * 10/1987 Delany ..... B01D 46/4227 55/504
5,273,564 A * 12/1993 Hill ..... B01D 46/0016 55/497
5,373,708 A * 12/1994 Dumoulin, Jr. ..... A45C 11/20 62/331
5,571,300 A * 11/1996 Stemmer ..... B01D 46/10 55/DIG. 39
5,665,936 A * 9/1997 Sawamura ..... H02G 7/12 174/32
5,709,249 A * 1/1998 Okada ..... H02G 3/0418 174/101
5,935,282 A * 8/1999 Lin ..... B01D 46/10 55/501
6,099,097 A * 8/2000 Hocker ..... G06F 1/181 16/257
6,126,123 A * 10/2000 Yang ..... B60R 16/0215 248/74.1
6,197,077 B1 * 3/2001 Simmons ..... B01D 46/10 55/491
6,234,429 B1 * 5/2001 Yang ..... B60R 16/0215 248/68.1
6,264,713 B1 * 7/2001 Lewis, II ..... B01D 46/521 55/502
6,334,881 B1 * 1/2002 Giannetta ..... B01D 39/1623 55/528
6,393,777 B1 * 5/2002 Renfrow ..... E06B 9/02 248/475.1
6,532,702 B1 * 3/2003 Scribner ..... E06B 9/02 49/63
6,623,540 B2 * 9/2003 Clayton ..... F24F 8/108 55/DIG. 35
6,966,935 B1 * 11/2005 Neighbors ..... B01D 46/48 55/498
7,323,028 B2 * 1/2008 Simmons ..... B01D 46/0005 55/501
7,350,364 B2 * 4/2008 Meerpohl ..... A01K 1/0082 62/310
7,604,127 B2 * 10/2009 Freissle ..... B07B 1/46 209/412
7,842,116 B2 * 11/2010 Simmons ..... B01D 46/10 55/480
8,196,990 B2 * 6/2012 Aebker ..... B60N 2/36 296/69
9,561,456 B2 * 2/2017 Simmons ..... B01D 46/0005
9,683,363 B2 * 6/2017 Pearson ..... G10K 11/16
10,040,149 B2 * 8/2018 Simmons ..... F24F 13/084
10,364,994 B2 * 7/2019 Kelly ..... F24F 8/125
10,434,448 B1 * 10/2019 Honnecke ..... F24F 13/28
11,077,399 B2 * 8/2021 Choi ..... F24F 13/20
11,466,876 B2 * 10/2022 Park ..... B01F 23/215
11,654,387 B2 * 5/2023 Bae ..... B01D 46/44 96/408
11,656,658 B2 * 5/2023 Jin ..... H04M 1/72454 345/156
2003/0134091 A1 * 7/2003 Wade ..... E04C 2/20 428/182
2003/0230062 A1 * 12/2003 Kubokawa ..... B01D 46/0005 55/497
2004/0154242 A1 * 8/2004 Hudoba ..... F16B 43/00 52/202
2004/0172928 A1 * 9/2004 Kubokawa ..... B01D 46/0005 55/497
2005/0235620 A1 * 10/2005 Connor ..... B01D 46/88 55/498
2007/0012192 A1 * 1/2007 Pippel ..... B01D 46/44 96/417
2009/0188218 A1 * 7/2009 Pippel ..... B01D 46/0005 55/483
2010/0058724 A1 * 3/2010 Kim ..... B01D 46/0005 55/495
2010/0146881 A1 * 6/2010 Framer ..... E06B 9/02 52/202
2012/0012523 A1 * 1/2012 Canonico ..... D04H 1/728 210/507
2012/0060454 A1 * 3/2012 Banks ..... B01D 46/4227 55/493
2016/0052095 A1 * 2/2016 Simmons ..... B01D 46/645 29/281.5
2016/0230713 A1 * 8/2016 Khami ..... F16B 7/22
2016/0280045 A1 * 9/2016 Nefzer ..... B01D 46/0005
2017/0106321 A1 * 4/2017 Montalti ..... E05D 15/48
2017/0128868 A1 * 5/2017 Simmons ..... F16B 11/006
2017/0128869 A1 * 5/2017 Simmons ..... B01D 46/10
2017/0182445 A1 * 6/2017 Zhang ..... B01D 46/521
2017/0191452 A1 * 7/2017 Baek ..... F02M 35/0201
2017/0232373 A1 * 8/2017 Chang ..... B01D 46/0005 55/467
2018/0036668 A1 * 2/2018 Stoner, Jr. ..... B01D 46/4254
2018/0100666 A1 * 4/2018 Park ..... F24F 6/04
2018/0185970 A1 * 7/2018 Simmons ..... B01D 46/0005
2018/0207569 A1 * 7/2018 Salpietra ..... B01D 46/0005
2021/0063026 A1 * 3/2021 Kim ..... F24F 1/0071
2021/0172628 A1 * 6/2021 Park ..... B01F 23/215
2021/0215389 A1 * 7/2021 Chun ..... F24F 1/005
2021/0325063 A1 * 10/2021 Park ..... F24F 13/20
2022/0146120 A1 * 5/2022 Seo ..... F04D 29/441
2022/0404045 A1 * 12/2022 Park ..... A61L 9/20

FOREIGN PATENT DOCUMENTS

KR 20-0148472 6/1999
KR 10-0294674 9/2001
KR 10-0280773 10/2001
KR 10-2001-0102597 11/2001
KR 10-0492320 6/2005
KR 10-0564496 B1 3/2006
KR 10-0784853 12/2007
KR 10-0842975 7/2008
KR 10-2008-0110154 A 12/2008
KR 10-0910842 B1 8/2009
KR 10-2010-00052375 A 5/2010
KR 10-1168758 7/2012
KR 10-2014-0121071 A 10/2014
KR 10-2017-0005943 A 1/2017
KR 10-2018-0108131 A 10/2018
KR 10-1964691 4/2019
WO WO-2022050582 A1 * 3/2022
WO WO-2022071653 A1 * 4/2022 ..... B01D 46/0047
WO WO-2022075567 A1 * 4/2022
WO WO-2022092529 A1 * 5/2022
WO WO-2022102938 A1 * 5/2022
WO WO-2022102969 A1 * 5/2022 ..... F04D 29/162

* cited by examiner

FILTER DEVICE AND AIR CLEANER HAVING THE SAME

CROSS-REFERENCE TO RELATED APPLICATIONS

This application is based on and claims priority under 35 U.S.C. § 119 to Korean Patent Application No. 10-2020-0047951, filed on Apr. 21, 2020 in the Korean Intellectual Property Office, the disclosure of which is incorporated herein by reference.

BACKGROUND

1. Field

The disclosure relates to a home appliance, and more specifically, to an air treatment apparatus, such as an air purifier or air conditioner including a filter device.

2. Description of the Related Art

In general, there is an increasing trend of home appliances requiring various functions for conditioning air, such as air conditioners, air purifiers, humidifiers, and dehumidifiers. An air purifier is an apparatus that is provided indoors and filters out or sterilizes fine dust in the air.

In detail, the air purifier suctions contaminated indoor air and filters out dust and odor particles contained in the air to purify the suctioned air into clean air so that the purified air is discharged to the outside of the air purifier, that is, to the indoors.

The air purifier may include a main body, and an air suction portion and an air discharge port formed in the main body.

In this case, a deodorizing filter that removes the odor of the air may have a low efficiency.

SUMMARY

Therefore, it is an aspect of the disclosure to provide an air purifier including a filter device capable of allowing each attachment and detachment of a functional filter.

It is another aspect of the disclosure to provide an air purifier including a filter device capable of allowing easy cleaning and replacing of a functional filter by separating the functional filter when the functional filter is contaminated.

It is another aspect of the disclosure to provide an air purifier including a filter device in which the use of a filter is expanded to various applications.

It is another aspect of the disclosure to provide a filter device and an air conditioner capable of facilitating attachment and detachment of a functional filter that is added to a filter.

Additional aspects of the disclosure will be set forth in part in the description which follows and, in part, will be obvious from the description, or may be learned by practice of the disclosure.

According to an aspect of the disclosure, there is provided an air purifier including: a main body: a suction port provided to allow air to flow into the main body; a filter provided in the main body to filter the air suctioned from the suction port and including a frame and a filter body fixed to the frame; an auxiliary filter member separably mounted on the filter; and a locking device provided on the frame of the filter such that the auxiliary filter member is separably mounted on the frame of the filter.

The locking device may include: a locking portion provided on the frame of the filter; and a locking member coupled to the locking portion by being pressed on the locking portion to lock or unlock the auxiliary filter member.

The auxiliary filter member may further include a fastening hole formed to be locked with or unlocked from the frame of the filter by the locking portion and the locking member.

The filter may include a hinge shaft on which the locking member is rotatably supported, and the locking member may include a hinge groove provided to be rotatably coupled to the hinge shaft.

The locking portion may include a locking protrusion formed to protrude from the filter, and the locking member may include a locking hole corresponding to the locking protrusion.

The air purifier may further include a support portion formed to support the coupling between the locking member and the locking portion, wherein the support portion may include a first support rib formed on the locking member, and a second support rib formed on the filter to correspond to the first support rib.

The locking portion may further include a plurality of protrusions formed to protrude from the filter, and the auxiliary filter member may be arranged between the plurality of protrusions and the locking member.

The locking portion may further include a first groove formed as a recession in the frame of the filter, the locking member may include a first protrusion corresponding to the first groove, and the fastening hole of the auxiliary filter member may be located between the first groove and the first protrusion.

The filter may further include a pre-filter and a dust collecting filter, and the auxiliary filter member may be arranged on one surface of at least one of the pre-filter and the dust collecting filter.

The auxiliary filter member may be formed of a mesh material including nylon and polyester.

The locking member may further include an extension portion formed to extend outward of the locking member to be coupled to at least a portion of the filter.

The extension portion may further include a hook provided to be hooked with the filter.

The locking portion may further include a separation preventing portion formed to protrude outward to prevent the fastening hole of the auxiliary filter member from being separated.

The locking device may be arranged on each of four corners of the filter.

According to another aspect of the disclosure, there is provided an air purifier including: a main body provided with a suction port and a discharge port; a fan arranged inside the main body; a filter arranged between the suction port and the fan to filter suctioned air; an auxiliary filter member separably mounted on the filter; and a locking device provided on the filter to separably connect the filter and the auxiliary filter member to each other, wherein the locking device includes: a locking portion provided on the filter, and a locking member coupled to the locking portion by being pressed on the locking portion for the auxiliary filter member to be locked with or unlocked from the filter.

The auxiliary filter member may further include a fastening hole formed to be locked with or unlocked from the filter by the locking portion and the locking member.

The filter may include a hinge shaft on which the locking member is rotatably supported, and the locking member may include a hinge groove provided to be rotatably coupled to the hinge shaft.

The locking portion may include a locking protrusion formed to protrude from the filter, and the locking member may include a locking hole corresponding to the locking protrusion.

The air purifier may further include a support portion formed to support the coupling between the locking member and the locking portion, wherein the support portion may include a first support rib formed on the locking member, and a second support rib formed on the filter to correspond to the first support rib.

The locking member may be integrally formed with the filter.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
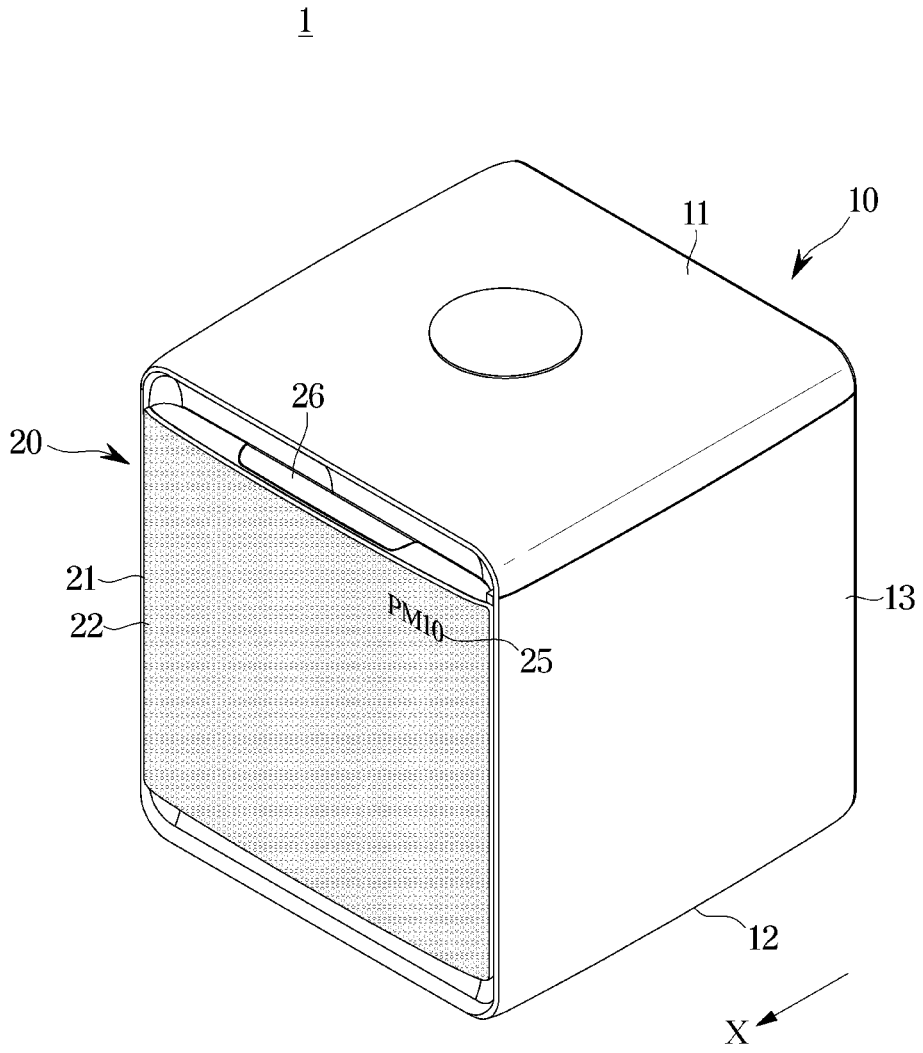
FIG. 1 is a perspective view illustrating an air purifier according to an embodiment of the disclosure.

Embodiments and features as described and illustrated in the disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~and/or~," or the like.

The terms "front", "rear", "upper", "lower", "top", and "bottom" as herein used are defined with respect to the drawings, but the terms may not restrict the shape and position of the respective components.

The disclosure may be applied to various home appliances for processing air, such as an air conditioner, an air purifier, a humidifier, a dehumidifier, and the like, but the following description will be made in relation to an air purifier as an example.

Figure 2:
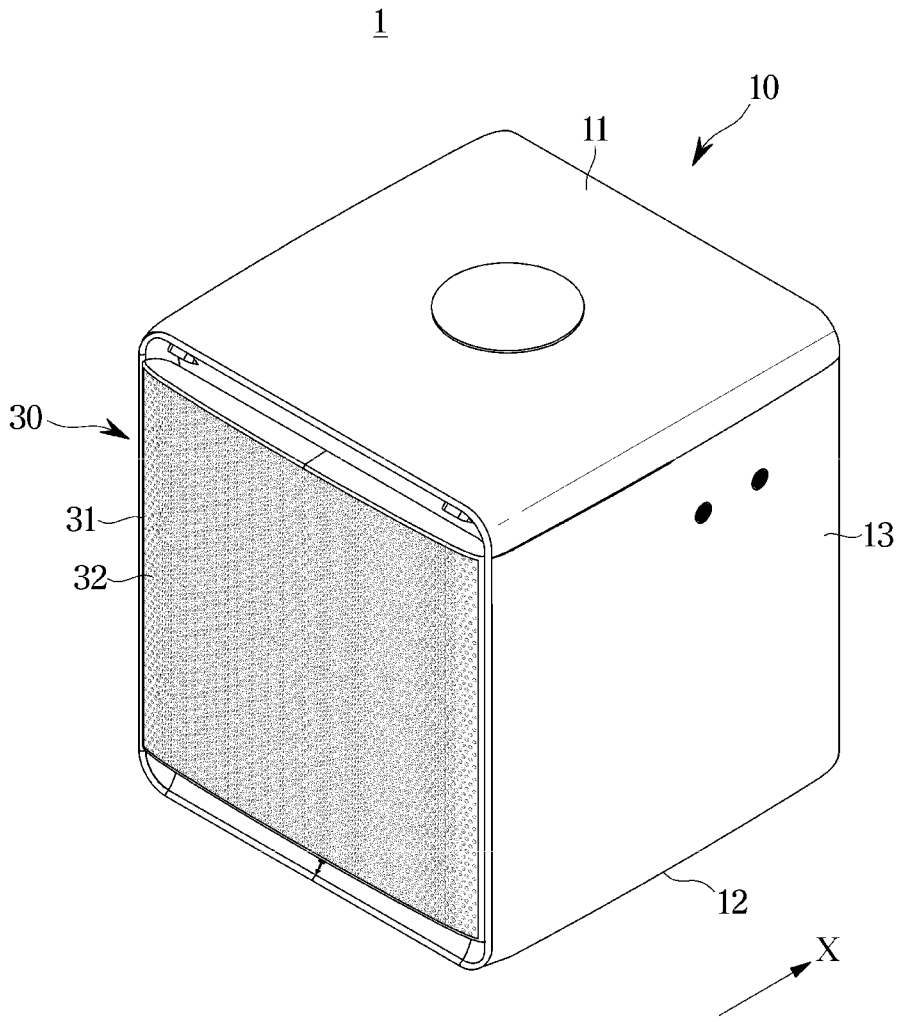
FIG. 2 is a perspective view illustrating a rear side of an air purifier according to an embodiment of the disclosure.
Figure 3:
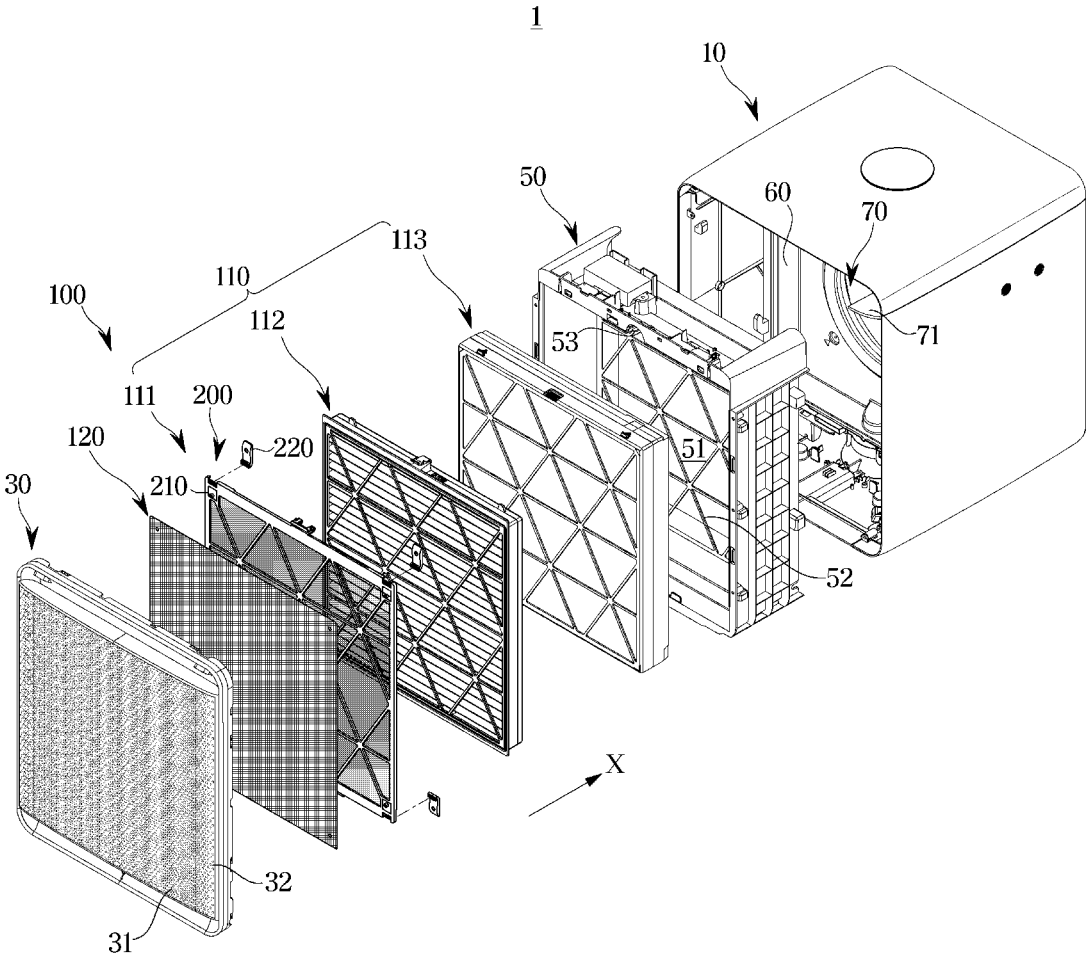
FIG. 3 is an exploded perspective view schematically illustrating an air purifier according to an embodiment of the disclosure.

FIG. 1 is a perspective view illustrating an air purifier according to an embodiment of the disclosure, FIG. 2 is a perspective view illustrating a rear side of an air purifier according to an embodiment of the disclosure, and FIG. 3 is an exploded perspective view schematically illustrating an air purifier according to an embodiment of the disclosure, Referring to FIGS. 1 and 3, an air purifier 1 includes a main body 10 forming the external appearance, a front panel 20 coupled to a front side of the main body 10 to form a front surface of the air purifier 1, and a rear panel 30 coupled to a rear side of the main body 10 to form a rear surface of the air purifier 1.

The main body 10 may include an upper panel 11 forming an upper surface of the main body 10, a lower panel 12 forming a lower surface of the main body 10, and side panels 13 forming both side surfaces of the main body 10. The main body 10 may be provided at the front and rear sides thereof with the front panel 20 and the rear panel 30, respectively.

The front panel 20 may be formed in a plate shape. The front panel 20 may be provided with a discharge portion 21 for discharging air purified inside the main body 10. The discharge portion 21 may include a discharge port 22. The discharge port 22 may be provided on the front side of the front panel 20. The discharge port 22 may be provided in at least one unit thereof. The number or location of the discharge port 22 is not limited, and the discharge ports 22 may be provided so that air is discharged in various directions. The front panel of the embodiment is illustrated as being configured on the front side of the main body as a separate unit, but the aspect of the disclosure is not limited thereto. For example, the front panel may be integrally formed with a case 10.

The front panel 20 may be provided with a manipulation button portion 26 for inputting an operation of the air purifier 1 and a display portion 25 provided to display an operation state.

The rear panel 30 may be formed in a plate shape having a size corresponding to the rear surface of the main body 10. The rear panel 30 is formed with a suction portion 31 through which external air is introduced from the outside. The suction portion 31 may include a plurality of suction ports 32 that are evenly distributed over the entire front surface of the rear panel 30.

The suction portion 31 of the rear panel 30 may be formed so that external air is introduced from the front side of the case 10 toward the inside of the case 10. Air introduced into the case 10 through the suction portion 31 may be discharged to the outside by the discharge portion 21 of the front panel 20.

The air purifier 1 includes a filter device 100, a blowing device 70, and a duct module 60 installed inside the main body 10.

The filter device 100 is mounted inside the main body 10 and provided to filter the air introduced through the suction portion 31 of the rear panel 30.

The filter device 100 may include a filter 110. The filter device 100 may include a plurality of the filters as shown in FIG. 3.

The filter device 100, in an implementation, may be provided in a size corresponding to that of the suction portion 31 of the rear panel 30.

The filter device 100 may be installed in a filter case 50. The filter device 100 is provided to fix the filter 110. The filter case 50 is provided to couple the filter device 100 to the main body 10.

The filter case 50 may include a filter accommodating portion 51 on which the filter device 100 is installed. The filter case 50 may have one surface that is open such that the filter device 100 is mounted on or separated from the opening.

The filter case 50 may have the other surface in which an air passage hole 52 is formed such that air purified through the filter device 100 is made to flow. The air passage hole 52 may be formed in plural. The air passage hole 52 is provided to allow air to flow to the duct module 60 and the blowing device 70.

The air passage hole 52 is provided in plural as shown in FIG. 3, but the disclosure is not limited thereto, and the air passage hole 52 may be provided as a single one.

Air that has passed through the filter device 100 is introduced into the duct module 60 through the air passage hole 52 of the filter case 50.

The duct module 60 may form a flow path of air through which air flows to the blowing device 70. In an embodiment of the disclosure, the duct module may be provided as a single unit and form one flow path so that air is discharged to the discharge portion 21 of the front panel 20, but the disclosure is not limited thereto, and the duct module may form flow paths in various numbers.

The blowing device 70 includes a blower fan 71 and a driving motor (not shown) provided to drive the blower fan 71. The blower fan 71 is provided to be rotated by receiving a rotational force from the driving motor. The blower fan 71 may include a centrifugal fan that suctions air in the axial direction and discharges the suctioned air in the radial direction. However, the disclosure is not limited thereto, and the blower fan 71 may be formed in various types of fans.

The duct module 60 may be provided so that air that has passed through the filter device 100 and introduced into the duct module 60 is discharged to the discharge port 22 of the front panel 20 by the blower fan 71.

Hereinafter, the filter device 100 will be described in detail.

The filter device 100 may include a filter 110 and an auxiliary filter member 120.

The filter 110 may include at least one of a plurality of filters 111, 112, and 113. The plurality of filters 111, 112, 113 may be various types of filters to filter out or remove pollutants, bacteria, viruses, dust, etc. in the air.

The filter 110 according to the embodiment of the disclosure includes three types of filters 111, 112, and 113, but the disclosure is not limited thereto and the filter 110 may additionally include various types of filters. For example, the filter 110 may additionally include a filter for removing formaldehyde, a filter for removing oil mist, a filter for sterilization and allergen removal, a filter for deodorization (ammonia, hydrogen sulfide, etc.), a dust filter, and the like.

The filter 110 may include a pre-filter 111 disposed adjacent to the suction portion 31 and collecting dust and foreign matters having a predetermined size or larger.

The filter 110 may include a dust collecting filter 113 provided to additionally collect foreign matter that has passed through the pre-filter 111.

The filter 110 may include a deodorizing filter 112 provided to collect odor particles contained in air through a chemical action.

When a direction toward the discharge portion 21 on the main body 10 is referred to as the first direction X, the pre-filter 111 may be provided to be disposed at the rearmost in the first direction X and the dust collecting filter 113 may be provided to be disposed at the front most in the first direction X among the filters.

The dust collecting filter 113 may be provided to collect foreign matter having a predetermined size that has passed through the pre-filter 111. The dust collecting filter 113 may be a High Efficiency Particulate Air (HEPA) filter that collects fine dust having a predetermined size. The HEPA filter may be composed of glass fibers. However, the disclosure is not limited thereto, and the dust collecting filter 113 may be provided in various types of filters that collects foreign substances.

The dust collecting filter 113 may be disposed in front of the pre-filter 111 in the first direction A.

The deodorizing filter 112 may be disposed between the pre-filter 111 and the dust collecting filter 113. However, the disclosure is not limited thereto, and the deodorizing filter 112 may be disposed in front of the dust collecting filter 113 in the first direction X.

The deodorizing filter 120 according to the embodiment of the disclosure may be provided as a photocatalytic filter that induces a chemical action of air using a photocatalyst. In detail, the deodorizing filter 200 may remove harmful substances, such as organic substants existing in the air, hydrogen sulfide, ammonia, nitrogen oxides (NOX), sulfur oxides (SOX), formaldehyde, etc., decompose source of offensive odor, such as acetaldehyde, ammonia, and hydrogen sulfide, and decompose organic substances, such as cigarette smoke and oil residue. In addition, the deodorizing filter 200 may remove gas, and may remove dust and the like by charging the dust and the like with photoelectrons.

In the embodiment of the disclosure, the filter 110 is illustrated as including at least one of the three filters, but the aspect of the disclosure is not limited thereto. For example, the filter may be formed of at least one filter. The pre-filter 111 is provided to primarily filter out dust having large particles in the air. In the embodiment of the disclosure, the description of the filter 110 will be made in relation to the pre-filter 111 provided to primarily filter out dust having large particles in the air as an example.

The filter 110 may include a frame 111*a* and a filter body 111*b* fixed to the frame 111*a*. The frame 111*a* may include a ceramic material or a metal material. For example, the frame 111*a* may be implemented with cordierlite or mulite composed of alumina and silica, or may be implemented with a material in which cordierite and mullite are combined. In an implementation, the frame 111*a* may be formed of an aluminum material.

The filter body 111*b* may be provided in a shape of a mesh having a plurality of holes. The filter body 111*b* may be formed by a plurality of fine holes so as to remove large-sized dust from the air flowing into the main body 10.

The filter 110 may be provided with a filter frame coupling portion 111*c* provided to be fixed to the filter case 50. The filter frame coupling portion 111*c* may be formed on an upper end of the frame 111*a*. The filter case 50 may be provided with a filter coupling portion 53 corresponding to the filter frame coupling portion 111*c*.

The filter device 100 may further include the filter 110 and an auxiliary functional filter additionally mounted on the filter 110.

The filter device 100 may include the auxiliary filter member 120 connected to the filter 110.

The filter device 100 may include the filter 110, the auxiliary filter member 120 separably provided on the filter 110, and a locking device 200 provided on the filter 110 to separably connect the filter 110 and the auxiliary filter member 120 to each other.

The auxiliary filter member 120 may be provided to primarily remove dust having large particles, such as household dust and pet hair. The auxiliary filter member 120 may be located adjacent to the suction portion 31 of the rear panel 30. The auxiliary filter member 120 may include a pretreatment filter or an ultrafine filter.

The auxiliary filter member 120 may be formed of a mesh material including nylon and polyester. The auxiliary filter member 120 may be formed of a plastic material, and may be provided in a form of a fine mesh.

The auxiliary filter member 120 is provided to be washed with running water or cleaned using a brush or a brush of a cleaner, or an electrostatic paper nonwoven fabric. The auxiliary filter member 120 may be cleaned or replaced for maintenance and repair when used for two weeks or one month due to the characteristics of the product.

The auxiliary filter member 120 may be separably coupled to the filter 110 by the locking device 200.

Figure 4:
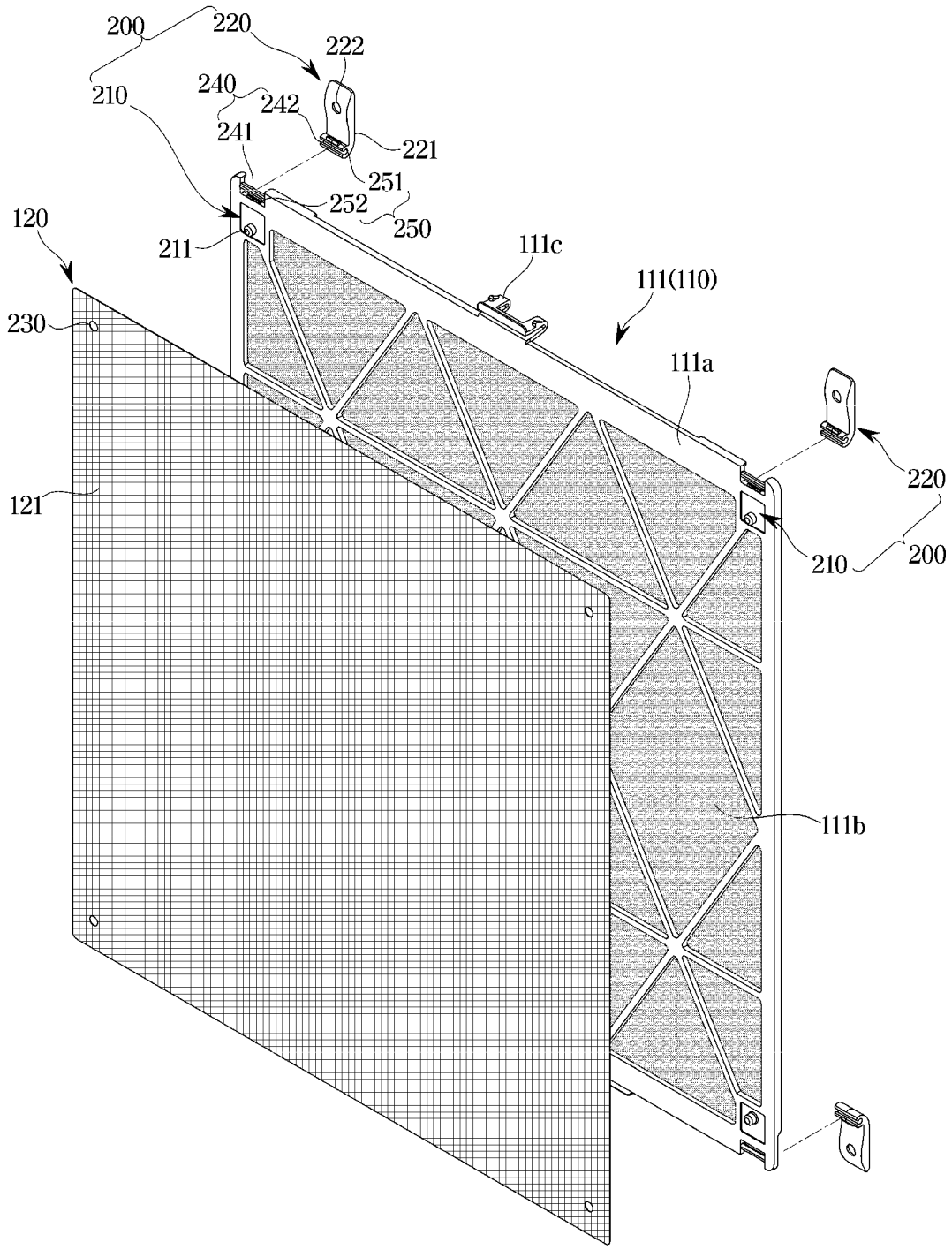
FIG. 4 is an exploded perspective view illustrating a filter device according to an embodiment of the disclosure.
Figure 5:
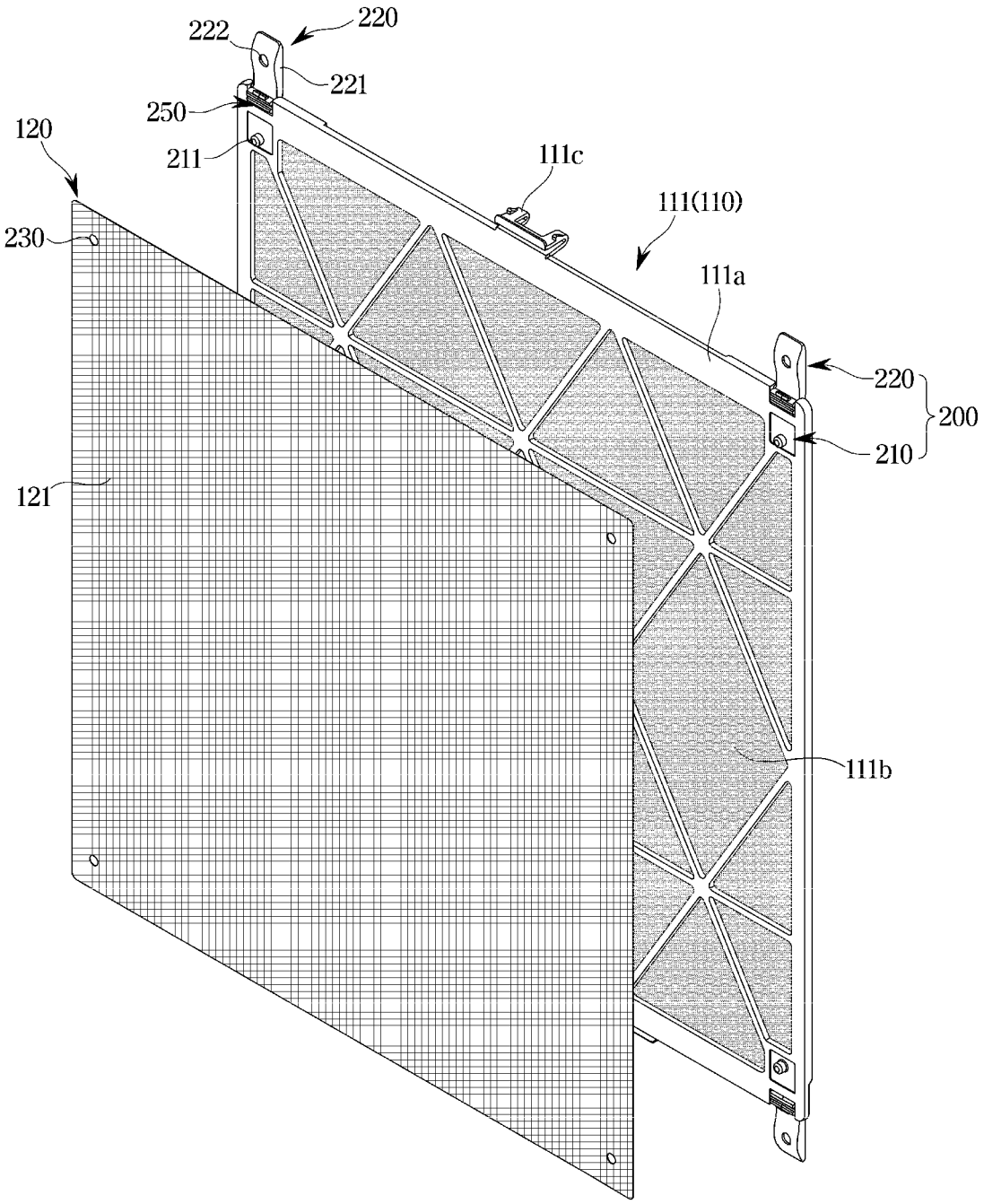
FIG. 5 is a view illustrating a filter equipped with a locking member and an auxiliary filter member according to an embodiment of the disclosure.
Figure 6:
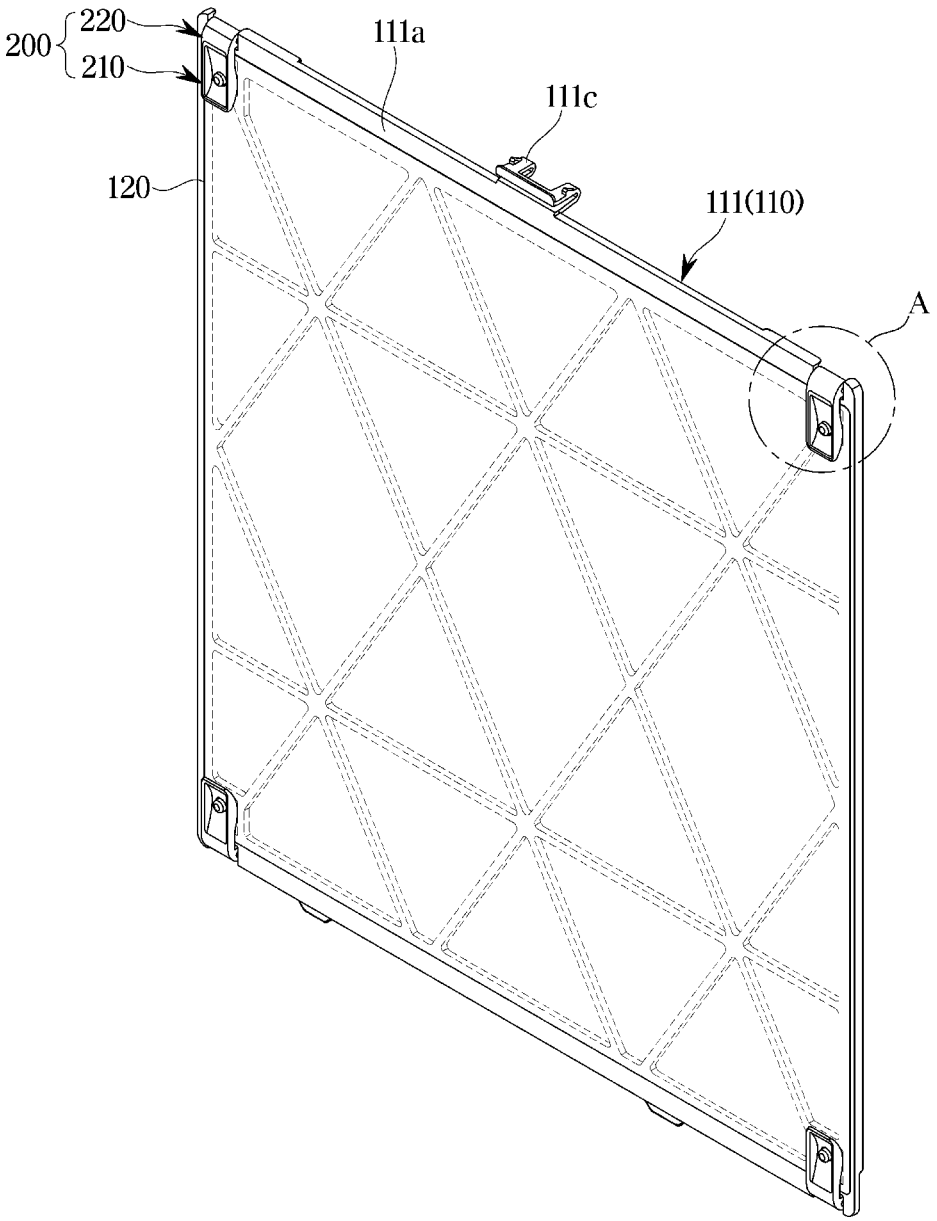
FIG. 6 is a view illustrating a state in which a filter and an auxiliary filter member are coupled to each other according to an embodiment of the disclosure.
Figure 7:
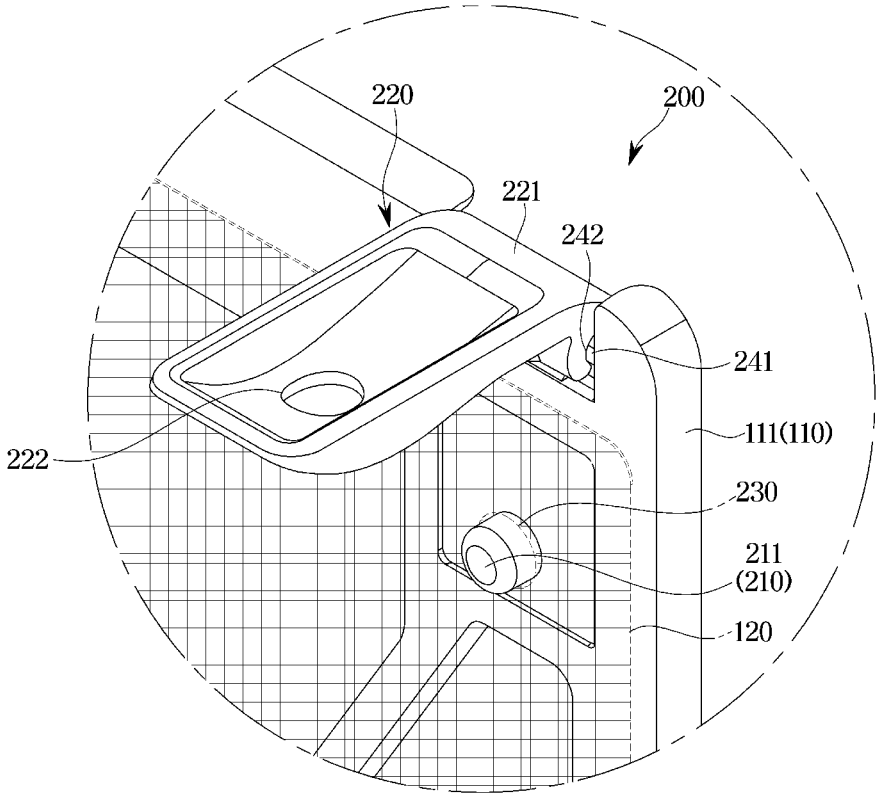
FIG. 7 is an enlarged view illustrating partA of FIG. 6, showing a state in which an auxiliary filter member is inserted into a locking portion of a filter according to an embodiment of the disclosure.
Figure 8:
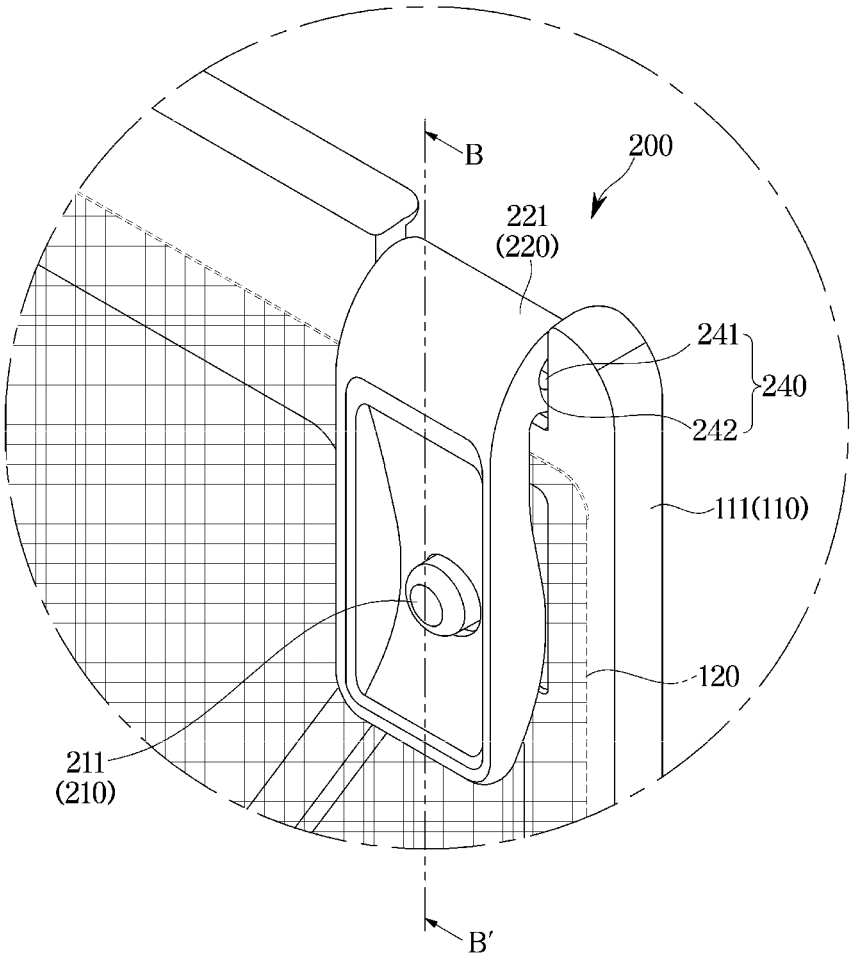
FIG. 8 is a view illustrating a state in which a locking member is coupled to a locking portion according to an embodiment of the disclosure.
Figure 9:
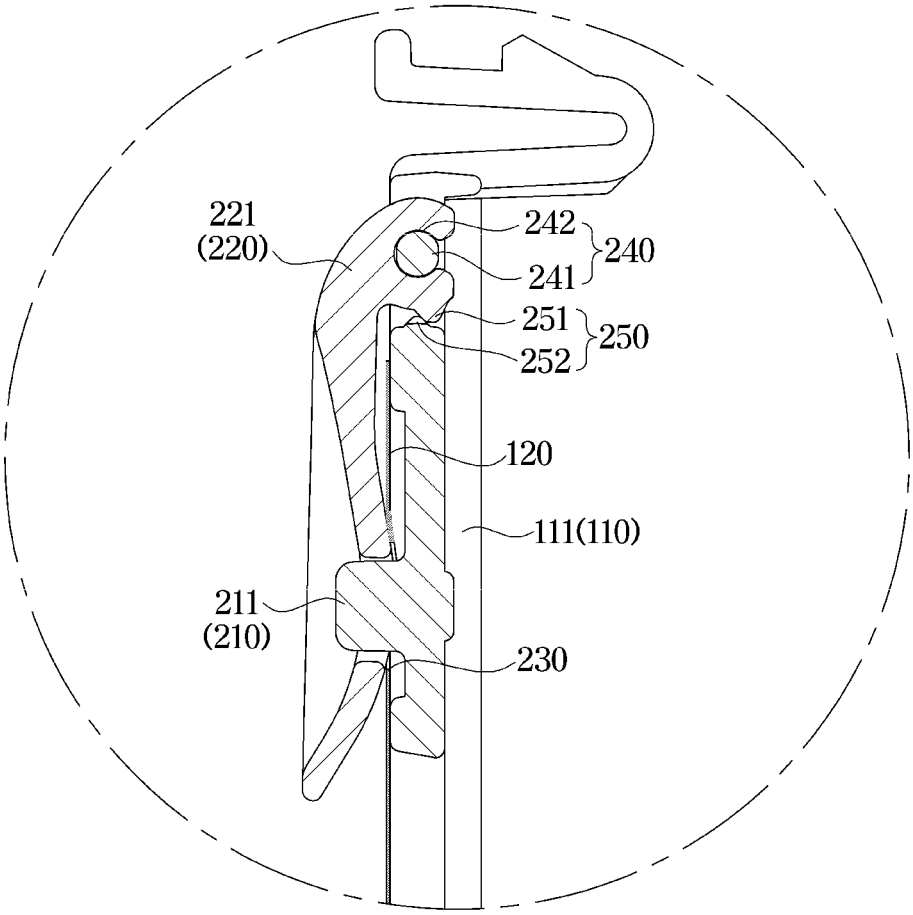
FIG. 9 is a cross-sectional view taken along line B-B' of FIG. 8, which shows an auxiliary filter member fixed to a filter by a locking member and a locking portion according to an embodiment of the disclosure.

FIG. 4 is an exploded perspective view illustrating a filter device according to an embodiment of the disclosure, FIG. 5 is a view illustrating a filter equipped with a locking member and an auxiliary filter member according to an embodiment of the disclosure, FIG. 6 is a view illustrating a state in which a filter and an auxiliary filter member are coupled to each other according to an embodiment of the disclosure, FIG. 7 is an enlarged view of part A of FIG. 6, showing a state in which an auxiliary filter member is inserted into a locking portion of a filter according to an embodiment of the disclosure, FIG. 8 is a view illustrating a state in which a locking member is coupled to a locking portion according to an embodiment of the disclosure, and FIG. 9 is a cross-sectional view taken along line B-B' of FIG. 8, which shows an auxiliary filter member fixed to a filter by a locking member and a locking portion according to an embodiment of the disclosure;

Referring to FIGS. 4 to 9, the filter device 100 may include the filter 110, the auxiliary filter member 120, and a locking device 200 provided to separably couple the filter 110 and the auxiliary filter member 120 to each other.

The locking device 200 may include a locking portion 210 provided on the filter 110 and a locking member 220 coupled to the locking portion 210 to lock or unlock the auxiliary filter member 120.

The locking device 200 including the locking portion 210 and the locking member 220 may be provided in four units thereof, and disposed at respective corners of the filter 110. The locking devices 200 may be disposed at the four corners of the filter 110 and the auxiliary filter member 120. The four locking devices 200 each having the locking portion 210 and the locking member 220 have the same configuration as each other, and in the following description, details of redundant descriptions thereof will be omitted. Hereinafter, the following description will be made in relation to the locking device 200 disposed at the upper right ends of the filter 110 and the auxiliary filter member 120, but the configuration and operation of other locking devices provided at the upper left ends, the lower left ends, and the lower right ends are the same as those of the following description.

The locking portion 210 may be provided on the filter 110. The locking portion 210 may be provided on the frame 111*a* of the filter 110. The locking portion 210 may include a locking protrusion 211 formed to protrude from the filter 110. The locking portion 210 may include the locking protrusion 211 formed to protrude from the frame 111*a* of the filter 110.

The locking protrusion 211 may protrude in a direction opposite to the first direction X of the filter 110. The locking protrusion 211 may be formed to protrude to the rear of the filter 110. The locking protrusion 211 may be formed to protrude toward the auxiliary filter member 120 from the frame 111*a* so as to be coupled to the auxiliary filter member 120. The locking portion 210 may be injection-molded integrally with the filter 110. The locking portion 210 may be injection-molded integrally with the frame 111*a*. The locking protrusion 211 may be injection-molded integrally with the filter 110. The locking protrusion 211 may be injection-molded integrally with the frame 111*a*.

The auxiliary filter member 120 may include a fastening hole 230 coupled to the locking portion 210 to be locked to or unlocked from the filter 110 by the locking member 220.

The auxiliary filter member 120 may be formed as a quadrangular plate. The auxiliary filter member 120 may be formed corresponding in shape and size to the shape and the size of the filter 110. The auxiliary filter member 120 may be formed of a mesh 121 including nylon or polyester (PET), or in the form of a fine net. The auxiliary filter member 120 may be provided to primarily remove dust having large particles, such as household dust and pet hair.

The auxiliary filter member 120 may be provided at the four corners thereof with the fastening holes 230 formed to correspond to the locking portions 210 of the filter 110. The fastening hole 230 may be formed corresponding in shape and size to the shape and the size of the locking portion 210. The fastening hole 230 may be formed corresponding in shape and size to the shape and the size of the locking protrusion 211.

The locking member 220 may be rotatably coupled to the filter 110. The locking member 220 is provided to be coupled to the locking portion 210. The locking member 220 is provided to be coupled to the locking portion 210 to fix the auxiliary filter member 120 to the filter 110.

The locking member 220 may include a locking member body 221. The locking member 220 may be rotatably provided on the filter 110. The locking member body 221 may be rotatably provided on the filter 110.

The locking member 220 may be rotatably coupled to the filter 110. A hinge portion 240 for hinge-coupling between the locking member 220 and the filter 110 may be provided. The hinge portion 240 may include a hinge shaft 241 formed on the filter 110 and a hinge groove 242 formed in the locking member 220.

The filter 110 may include the hinge shaft 241. The hinge shafts 241 may be provided at the four corners of the filter 110. The hinge shaft 241 may be integrally formed with the filter 110.

The locking member 220 may include the hinge groove 242 corresponding to the hinge shaft 241 of the filter 110. The locking member 220 may include the hinge groove 242 rotatably coupled to the hinge shaft 241 of the filter 110. The hinge groove 242 may be formed at an end portion of one side of the locking member body 221. The hinge groove 242 may be formed at an end portion of an upper side of the locking member body 221. The locking member body 221 may be coupled to the filter 110 to be rotatable on the hinge groove 242.

The locking member body 221 is provided to be coupled to the filter 110. The locking member body 221 may be formed with a locking hole 222 corresponding to the locking portion 210. The locking hole 222 may be formed in the locking member body 221. The locking hole 222 may be formed corresponding in shape to the shape of the locking portion 210 of the filter 110. The locking hole 222 may be formed corresponding in size and shape to the size and shape of the locking protrusion 211 of the filter 110.

The locking hole 222 may have a size and shape smaller than that of the locking protrusion 211. The locking protrusion 211 may be inserted into and fixed to the locking hole 222 in a force-fitting manner.

The locking member 220 may be rotated on the hinge shaft 241 of the filter 110 and the hinge groove 242. The locking member body 221 may be rotated on the hinge shaft 241 of the filter 110 and the hinge groove 242. The locking member body 221 may be fixed to the filter 110 by the locking hole 222 being inserted around the locking protrusion 211. The locking hole 222 of the locking member 220 may be coupled to the filter 110 by being coupled to the locking protrusion 211.

A support portion 250 is provided to support coupling between the locking member 220 and the filter 110. The support portion 250 may be provided to limit rotation of the locking member 220 with respect to the filter 110.

The support portion 250 may include a first support rib 251 formed on the locking member 220 and a second support rib 252 formed on the filter 110 so as to correspond to the first support rib 251. The first support rib 251 is supported by the second support rib 252 of the filter 110 to secure the coupling of the locking member 220 and the filter 110.

In the embodiment of the disclosure, the locking member 220 is illustrated as being firmly coupled to the filter 110 by the support portion 250, but the aspect of the disclosure is not limited thereto. For example, the configuration of the support portion may be omitted.

The auxiliary filter member 120 is first temporarily assembled by the fastening hole 230 being inserted around the locking protrusion 211 of the filter 110, and in the temporary assembly state, the locking member 220 is rotated and pressed to couple the locking hole 222 to the locking protrusion 211, so that the locking member 220 is fixed to the filter 220.

In this case, the auxiliary filter member 120 is pressed by the locking member 220 while being insertedly coupled to the locking protrusion 211 of the filter 110, so that the auxiliary filter member 120 may be firmly fixed to the filter 110.

Conversely, when cleaning or replacing the auxiliary filter member 120, the locking member 220 is rotated to be separated from the locking portion 210 so that the auxiliary filter member 120 inserted into the locking portion 210 may be easily separated from the filter 110.

Hereinafter, a locking device 200A of the filter device 100 of the air purifier 1 according to another embodiment of the disclosure will be described. The configuration of the filter device to be described below is the same as that of the air purifier 1 and the filter device according to the above-described embodiment, and thus details of redundant descriptions are omitted.

Figure 10:
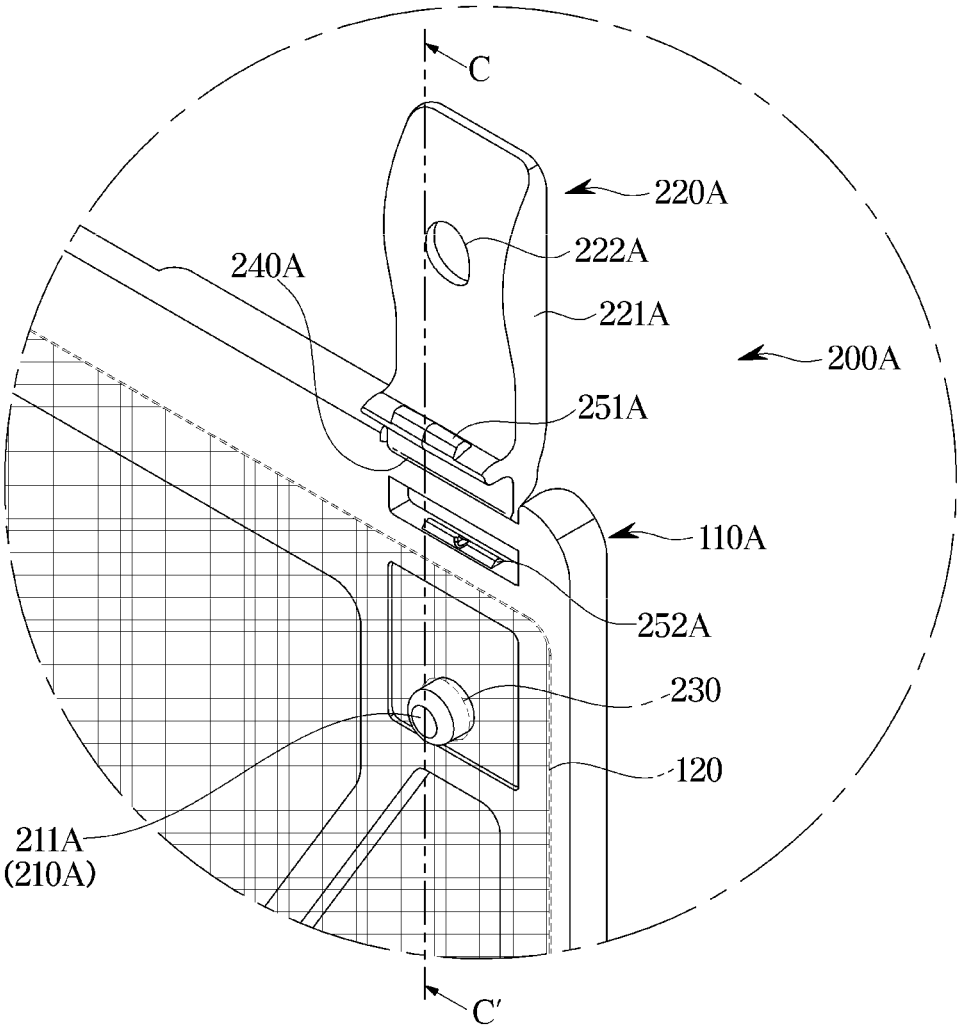
FIG. 10 is a perspective view illustrating a locking member and a locking portion of a locking device according to another embodiment of the disclosure.
Figure 11:
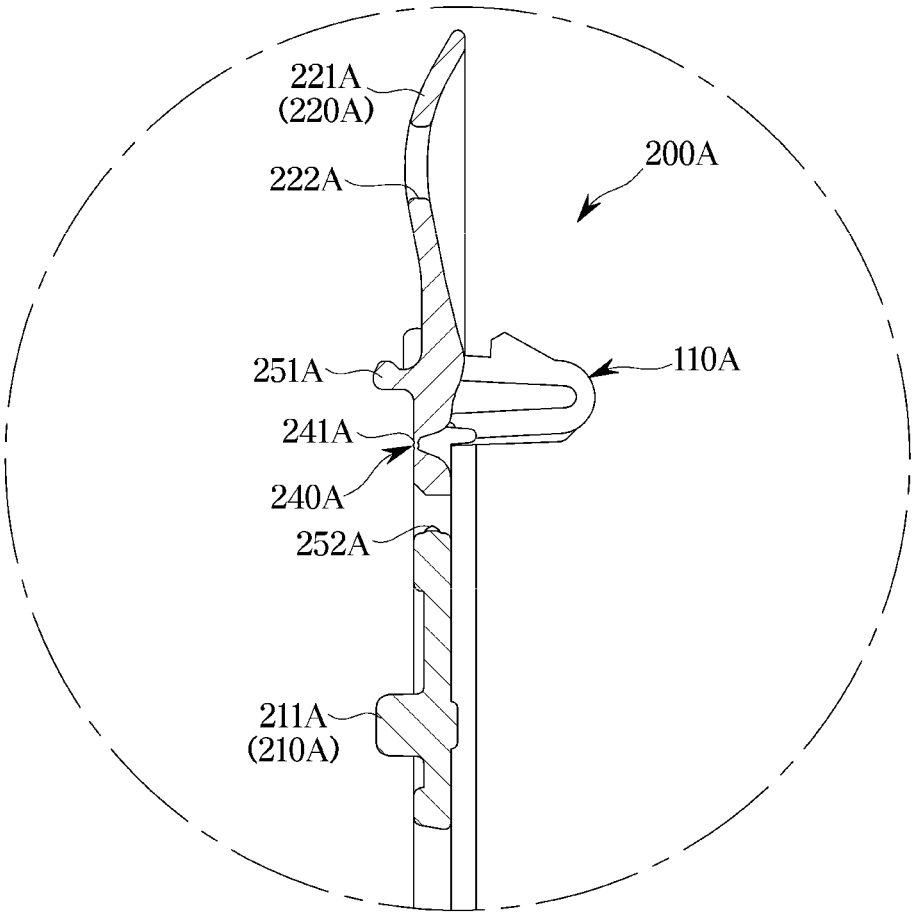
FIG. 11 is a cross-sectional view taken along line C-C' of FIG. 10, showing a locking device according to another embodiment of the disclosure.
Figure 12:
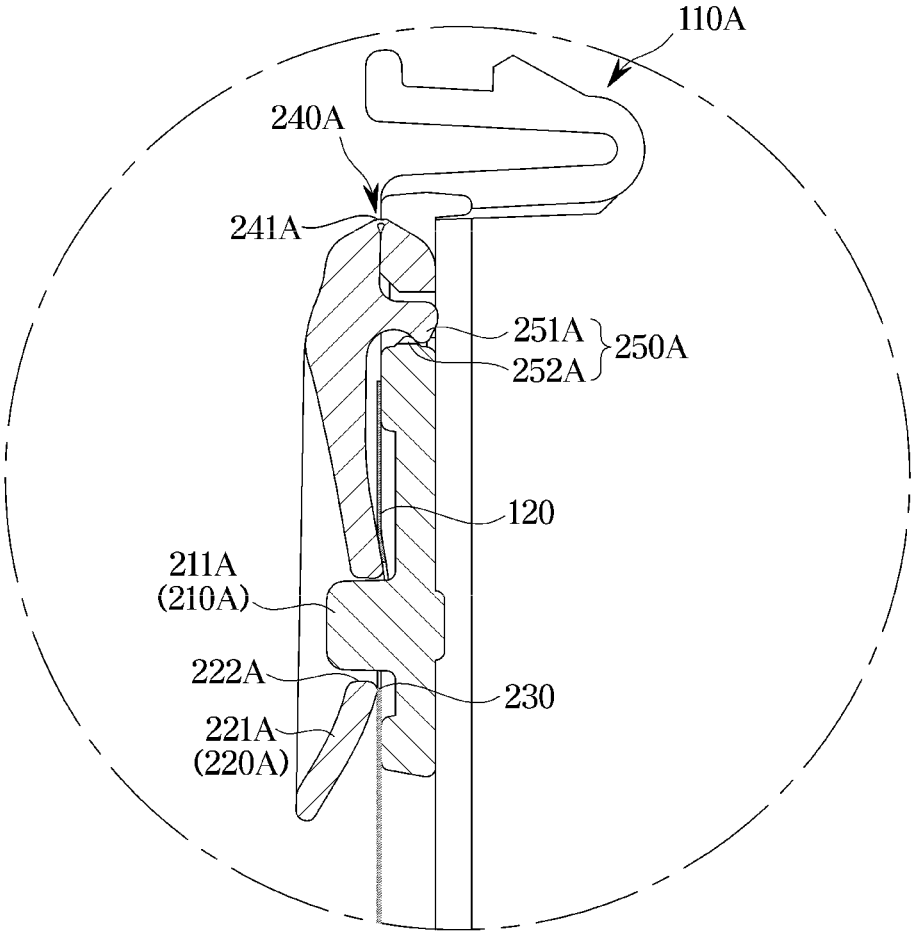
FIG. 12 is a cross-sectional view showing a state in which a filter and an auxiliary filter member are coupled to each other by a locking device according to another embodiment of the disclosure.

FIG. 10 is a perspective view showing a locking member and a locking portion of a locking device according to another embodiment of the disclosure, FIG. 11 is a cross-sectional view taken along line C-C' of FIG. 10, showing a locking device according to another embodiment of the disclosure, and FIG. 12 is a cross-sectional view showing a state in which a filter is coupled to an auxiliary filter member by a locking device according to another embodiment of the disclosure. FIGS. 1 to 10 are referred to reference numerals of components not shown in the drawings.

The filter device 100 may include a filter 110A, an auxiliary filter member 120, and a locking device 200A provided to separably couple the filter 110A and the auxiliary filter member 120 to each other.

The locking device 200A includes a locking portion 210A provided on the filter 110A and a locking member 220A coupled to the locking portion 210A and provided to lock or unlock the auxiliary filter member 120.

The locking portion 210A may be provided on the filter 110A. The locking portion 210A may include a locking protrusion 211A formed to protrude from the filter 110A. The locking protrusion 211A may protrude in a direction opposite to the first direction X of the filter 110A. The locking protrusion 211A may be formed to protrude to the rear of the filter 110A. The locking protrusion 211A may be formed to protrude toward the auxiliary filter member 120 so as to be coupled to the auxiliary filter member 120. The locking portion 210A may be injection-molded integrally with the filter 110A. The locking protrusion 211A may be injection-molded integrally with the filter 110A.

The auxiliary filter member 120 may include a fastening hole 230 coupled to the locking portion 210 to be locked to or unlocked from the filter 110 by the locking member 220.

The locking member 220A may be rotatably provided on the filter 110A. The locking member 220A may be connected to the filter 110A by a hinge 240A. The locking member 220A may be rotatably connected to the filter 110A by the hinge 240A. The locking member 220A may be injection-molded integrally with the filter 110A. The hinge 240A of the locking member 220A may be formed to have a thickness thinner than that of the filter 110A or other portions of the locking member 220A. The hinge 240A may include pleats 241A formed integrally with the filter 110A. The pleats 241A are provided to flexibly connect the hinge 240A to the frame 111*a* of the filter 110A. The pleats 241A may be provided to facilitate rotation of the hinge 240A. The pleats 241A of the hinge 240A allow the locking member 220A to be rotated upward or downward with respect to the filter 110A.

The locking member 220A is provided to be coupled to the locking portion 210A. The locking member 220A is provided to be coupled to the locking portion 210A to fix the auxiliary filter member 120 to the filter 110.

The locking member 220A may include a locking member body 221A. The locking member 220A may be rotatably coupled to the filter 110A by the hinge 240A. The locking member 220A may be formed with a locking hole 222A corresponding to the locking portion 210. The locking hole 222A may be formed in the locking member body 221A. The locking hole 222A may be formed corresponding in shape to the shape of the locking portion 210A of the filter 110A.

As the locking hole 222A of the locking member body 221A is inserted around the locking protrusion 211A, the locking member 220A may be fixed to the filter 110A. The locking protrusion 211A may be forcibly fitted into the locking hole 222A. The locking hole 222A may be formed with a diameter and size slightly smaller than that of the locking protrusion 211A so that the locking protrusion 211A is fixed by being forced fitted into the locking hole 222A.

The locking member 220A may further include a support portion 250A provided to support coupling between the locking member 220A and the filter 110. The support portion 250A may be provided to limit the rotation of the locking member 220A with respect to the filter 110A. The support portion 250A may include a first support rib 251A formed on the locking member 220A and a second support rib 252A formed on the filter 110A to correspond to the first support rib 251A. The first support rib 251A is provided to be supported by the second support rib 252A of the filter 110A to secure coupling between the locking member 220A and the filter 110A.

The auxiliary filter member 120 is first temporarily assembled by the fastening hole 230 being inserted around the locking protrusion 211A of the filter 110A, and in the temporary assembly state, the locking member 220A is rotated on the hinge 240A and pressed to couple the locking hole 222A to the locking protrusion 211A so that the locking member 220A is fixed to the filter 110A.

In this case, the auxiliary filter member 120 is pressed by the locking member 220A while being insertedly coupled to the locking protrusion 211A of the filter 110A, so that the auxiliary filter member 120 may be firmly fixed to the filter 110A.

Conversely, when cleaning or replacing the auxiliary filter member 120, the locking member 220A is rotated to be separated from the locking portion 210A so that the auxiliary filter member 120 inserted into the locking portion 210A may be easily separated from the filter 110A.

In the embodiment of the disclosure, the locking protrusion 211A is coupled by being inserted into the locking hole 222A and is firmly fixed by the support portion 250A, but the aspect of the disclosure is not limited thereto. For example, the locking protrusion may be insertedly fixed to the locking hole by force fitting, and in this case, the configuration of the support portion 250A may be omitted.

Hereinafter, a locking device 200B of the filter device 100 of the air purifier 1 according to another embodiment of the disclosure will be described. The configuration of the filter device to be described below is the same as that of the air purifier 1 and the filter device according to the above-described embodiment, and thus details of redundant descriptions will be omitted.

Figure 13:
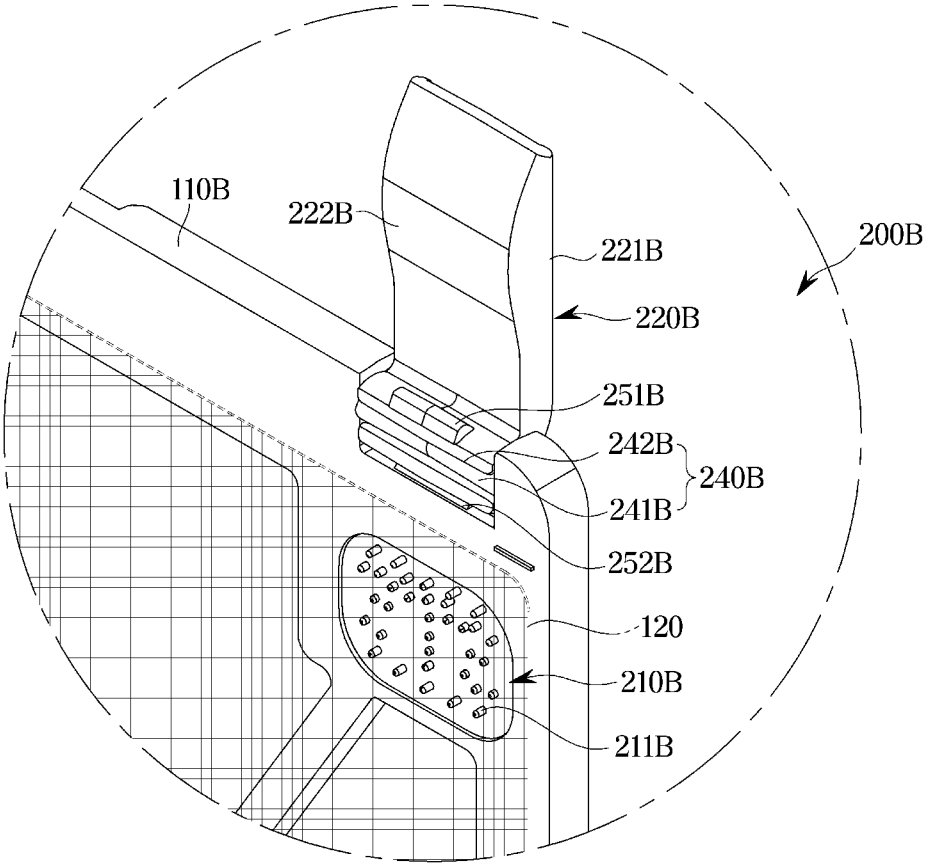
FIG. 13 is a perspective view illustrating a locking device according to still another embodiment of the disclosure.
Figure 14:
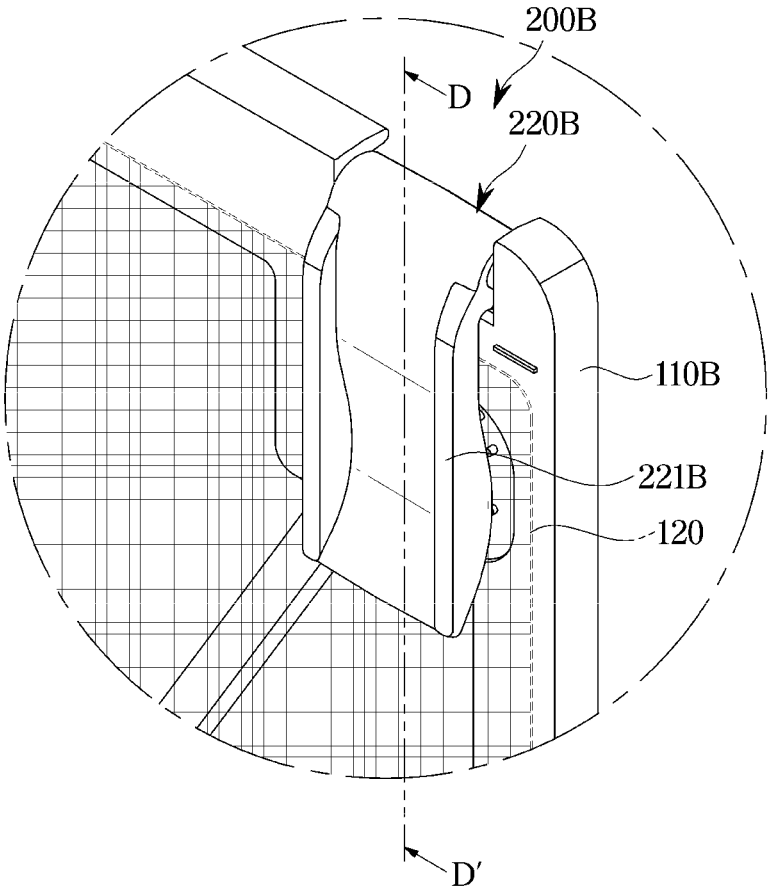
FIG. 14 is a view illustrating an auxiliary filter member coupled to a filter by a locking device according to still another embodiment of the disclosure.
Figure 15:
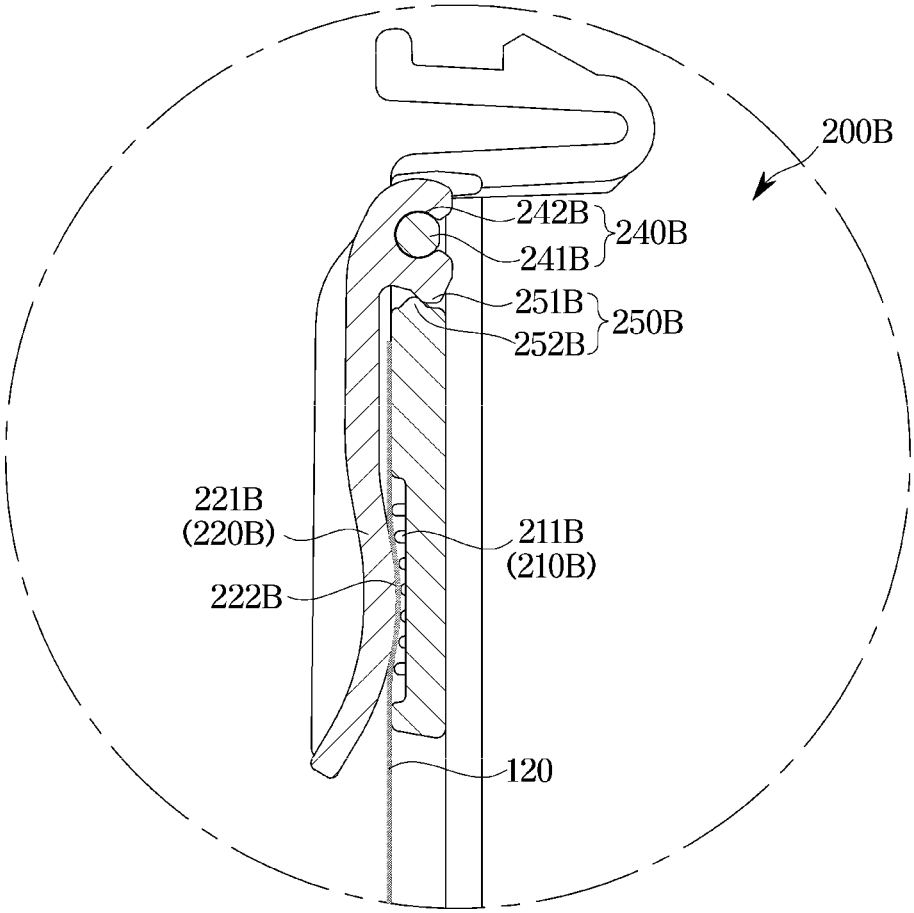
FIG. 15 is a cross-sectional view taken along line D-D' of FIG. 14, showing a locking device according to still another embodiment of the disclosure.

FIG. 13 is a perspective view illustrating a locking device according to another embodiment of the disclosure, FIG. 14 is a view illustrating an auxiliary filter member coupled to a filter by a locking device according to still another embodiment of the disclosure, and FIG. 15 is a cross-sectional view taken along line D-D' of FIG. 14, showing a locking device according to still another embodiment of the disclosure. FIGS. 1 to 10 are referred to reference numerals of components not shown in the drawings.

Referring to FIGS. 13 to 15, the filter device 100 may include a filter 110B, an auxiliary filter member 120, and a locking device 200B provided to separably couple the filter 110B to the auxiliary filter member 120.

The locking device 200B includes a locking portion 210B provided on the filter 110B and a locking member 220B coupled to the locking portion 210B and provided to lock or unlock the auxiliary filter member 120.

The locking portion 210B may be provided on the filter 110B. The locking portion 210B may include a plurality of protrusions 211B formed to protrude from the filter 110B. The plurality of protrusions 211B may protrude in a direction opposite to the first direction X of the filter 110B. The plurality of protrusions 211B may be formed to protrude to the rear of the filter 110B. The plurality of protrusions 211B may be formed to protrude toward the auxiliary filter member 120 so as to be coupled to the auxiliary filter member 120. The plurality of protrusions 211B may be formed to have different heights. The plurality of protrusions 211B may have different thicknesses.

The locking portion 210B may be injection-molded integrally with the filter 110B. The plurality of protrusions 211B may be injection-molded integrally with the filter 110B.

The auxiliary filter member 120 may be formed in a quadrangular plate shape. The auxiliary filter member 120 may be formed corresponding in shape and size to the shape and size of the filter 110.

The locking member 220B may be rotatably coupled to the filter 110B. The locking member 220B is provided to be coupled to the locking portion 210B. The locking member 220B is provided to be coupled to the locking portion 210B to firmly fix the auxiliary filter member 120 to the filter 110.

The locking member 220B may include a locking member body 221B. The locking member 220B may be rotatably provided on the filter 110B. The locking member body 221B may be rotatably provided on the filter 110B.

The locking member 220B may be rotatably coupled to the filter 110B. A hinge portion 240B for hinge coupling between the locking member 220B and the filter 110B may be provided. The hinge portion 240B may include a hinge shaft 241B formed on the filter 110B and a hinge groove 242B formed in the locking member 220B.

The filter 110B may include the hinge shaft 241B. The hinge shaft 241B may be integrally formed with the filter 110B.

The locking member 220B may include the hinge groove 242B corresponding to the hinge shaft 241B of the filter 110B. The locking member 220B may include the hinge groove 242B rotatably coupled to the hinge shaft 241B of the filter 110B. The hinge groove 242B may be formed at an end portion of one side of the locking member body 221B. The hinge groove 242B may be formed at an end portion of an upper side of the locking member body 221B. The locking member body 221B may be coupled to the filter 110 to be rotatable on the hinge groove 242B.

The locking member body 221B is provided to be coupled to the filter 110B. The locking member body 221B may be provided with a support surface 222B corresponding to the locking portion 210B. The support surface 222B may be formed on one surface of the locking member body 221B. The support surface 222B may be formed corresponding in shape to the shape of the locking portion 210B of the filter 110B.

The locking member 220B may be rotated on the hinge shaft 241B of the filter 110B and the hinge groove 242B. The locking member body 221B may be rotated on the hinge shaft 241B of the filter 110B and the hinge groove 242B. The locking member body 221B may come in contact with the plurality of protrusions 211B to support the auxiliary filter member 120. The auxiliary filter member 120 may be fixed to the filter 110B by making surface contact with the support surface 222B of the locking member body 221B.

The locking member 220B may further include a support portion 250B provided to support coupling between the locking member 220B and the filter 110B. The support portion 250B may be provided to limit rotation of the locking member 220B with respect to the filter 110B. The support portion 250B may include a first support rib 251B formed on the locking member 220B, and a second support rib 252B formed on the filter 110B to correspond to the first support rib 251B.

In the embodiment of the disclosure, the locking member 220B is firmly fixed to the filter 110B by the support portion 250B, but the aspect of the disclosure is not limited thereto. For example, the configuration of the support portion may be omitted.

Hereinafter, a locking device 2000 of the filter device 100 of the air purifier 1 according to another embodiment of the disclosure will be described. The configuration of the filter device to be described below is the same as that of the air purifier 1 and the filter device according to the above-described embodiment, and thus details of redundant descriptions will be omitted.

Figure 16:
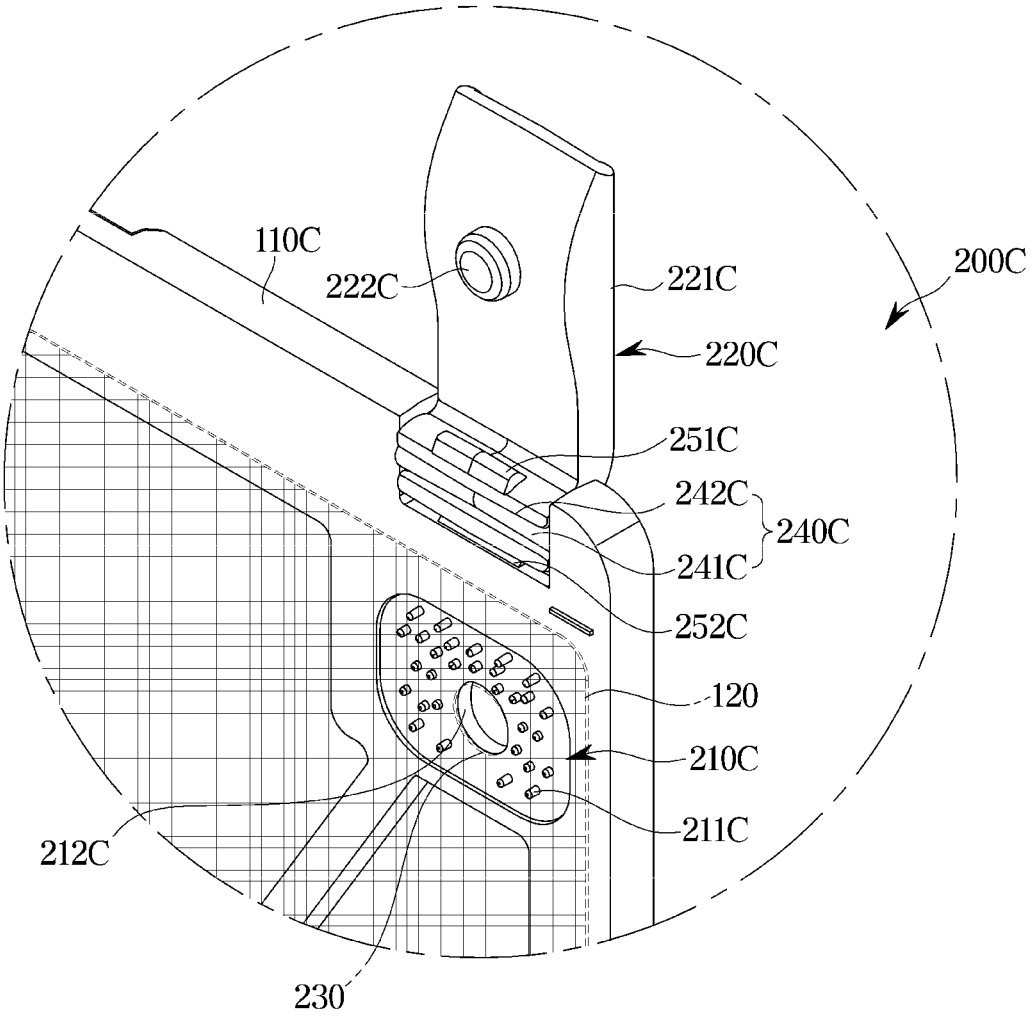
FIG. 16 is a perspective view illustrating a locking device according to still another embodiment of the disclosure.
Figure 17:
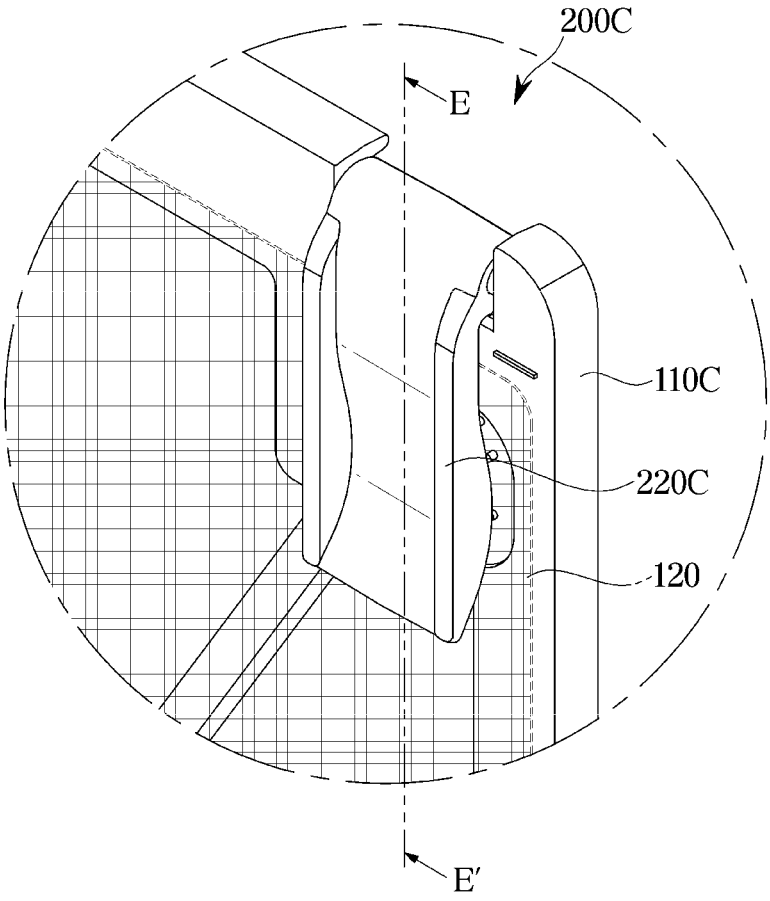
FIG. 17 is a view illustrating an auxiliary filter member coupled to a filter by a locking device according to still another embodiment of the disclosure.
Figure 18:
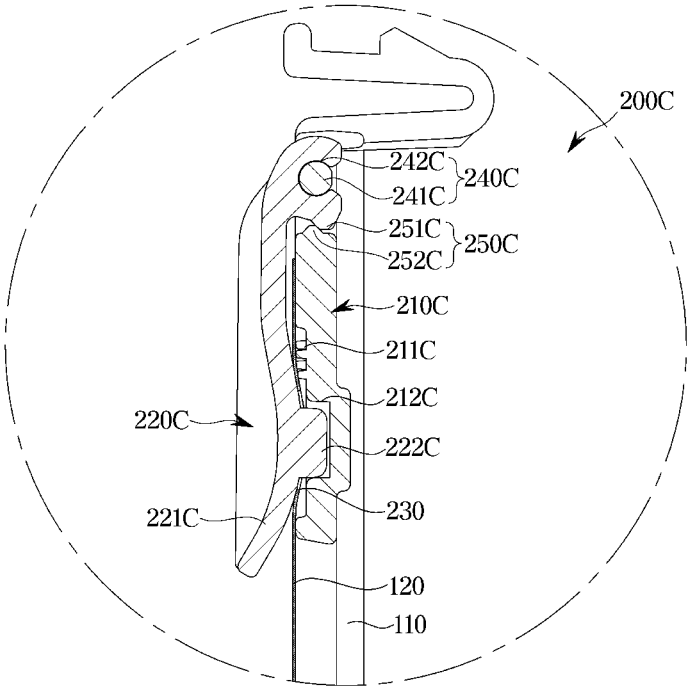
FIG. 18 is a cross-sectional view taken along line E-E' of FIG. 17, showing a locking device according to still another embodiment of the disclosure.

FIG. 16 is a perspective view illustrating a locking device according to still another embodiment of the disclosure, FIG. 17 is a view illustrating an auxiliary filter member coupled to a filter by a locking device according to still another embodiment of the disclosure, and FIG. 18 is a cross-sectional view taken along line E-E' of FIG. 17, showing a locking device according to still another embodiment of the disclosure. FIGS. 1 to 10 are referred to reference numerals of components not shown in the drawings.

Referring to FIGS. 16 to 18, the filter device 100 may include a filter 110C, an auxiliary filter member 120, and a locking device 2000 provided to separably couple the filter 110C and the auxiliary filter member 120 to each other.

The locking device 2000 may include a locking portion 210C provided on the filter 110C and a locking member 220C coupled to the locking portion 210C and provided to lock or unlock the auxiliary filter member 120.

The locking portion 210C may be provided on the filter 110C. The locking portion 210C may include a plurality of protrusions 211C formed to protrude from the filter 110C. The plurality of protrusions 211C may be formed to have different heights. The plurality of protrusions 211C may be formed to have different thicknesses. The plurality of protrusions 211C may protrude in a direction opposite to the first direction X of the filter 110C. The plurality of protrusions 211C may protrude to the rear of the filter 110C. The plurality of protrusions 211C may be injection-molded integrally with the filter 110C.

The locking portion 210C may include a first groove 212C formed as a recession in the filter 110C. The first groove 212C may be located at the center of the plurality of protrusions 211C.

The auxiliary filter member 120 may include a fastening hole 230 formed to correspond to the locking portion 210C to be locked to or unlocked from the filter 110 by the locking member 220C.

The fastening hole 230 formed to correspond to the locking portion 210C of the filter 110C may be provided at each of the four corner of the auxiliary filter member 120. The fastening hole 230 may be formed corresponding in shape and size to the shape and size of the locking portion 210C. The fastening hole 230 may be formed corresponding in shape and size to the shape and size of the first groove 212C.

The locking member 220C may be rotatably coupled to the filter 110C. The locking member 220C is provided to be coupled to the locking portion 210C. The locking member 220C is provided to be coupled to the locking portion 210C to fix the auxiliary filter member 120 to the filter 110.

The locking member 220C may include a locking member body 221C. The locking member 220C may be rotatably provided on the filter 110C. A hinge portion 240C for hinge coupling between the locking member 220C and the filter 110C may be provided. The hinge portion 240C may include a hinge shaft 241C formed on the filter 110C and a hinge groove 242C formed in the locking member 220C.

The locking member body 221C may be coupled to the filter 110C to be rotatable on the hinge groove 242C. The locking member body 221C is provided to be coupled to the filter 110C. The locking member body 221C may be formed with a first protrusion 222C corresponding to the locking portion 210C. The locking member body 221C may be formed with the first protrusion 222C corresponding to the first locking groove 212C.

The locking member 220C may be rotated on the hinge portion 240C. The first protrusion 222C of the locking member body 221C may be inserted into the first groove 212C so that the locking member 220C may be fixed to the filter 110.

In this case, the first protrusion 222C of the locking member 220C may be formed larger than the first groove 212C, and thus may be inserted to be fixed to the first groove 212C in a force-fitting manner.

The locking member 220C may further include a support portion 250C provided to support coupling between the locking member 220C and the filter 110C. The support portion 250C may include a first support rib 251C formed on the locking member 220C and a second support rib 252C formed on the filter 110C to correspond to the first support rib 251C. The first support rib 251C is supported by the second support rib 252C of the filter 110C and provided to secure the coupling between the locking member 220C and the filter 110C.

The auxiliary filter member 120 is first temporarily assembled by the plurality of protrusions 211C of the filter 110C, and in the temporary assembly state, the locking member 220C is rotated and pressed so that the first protrusion 222C of the locking member 220C is inserted into the first groove 212C by passing through the fastening hole 230 of the auxiliary filter member 120 to thereby be coupled to the filter 110C.

In the embodiment of the disclosure, the locking member 220C is firmly fixed to the filter 110C by the support portion 250C, but the aspect of the disclosure is not limited thereto. For example, the configuration of the support portion may be omitted.

Hereinafter, a locking device 200D of the filter device 100 of the air purifier 1 according to another embodiment of the disclosure will be described. The configuration of the filter device to be described below is the same as that of the air purifier 1 and the filter device according to the above-described embodiment, and thus details of redundant descriptions will be omitted.

Figure 19:
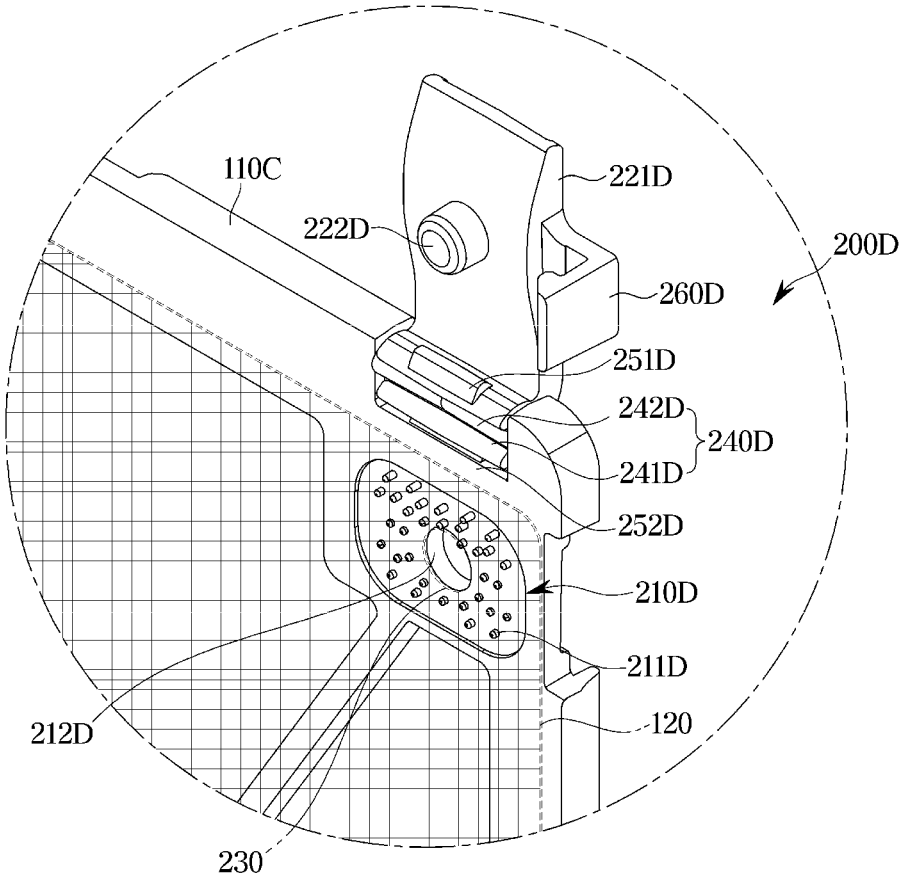
FIG. 19 is a perspective view illustrating a locking device according to still another embodiment of the disclosure.
Figure 20:
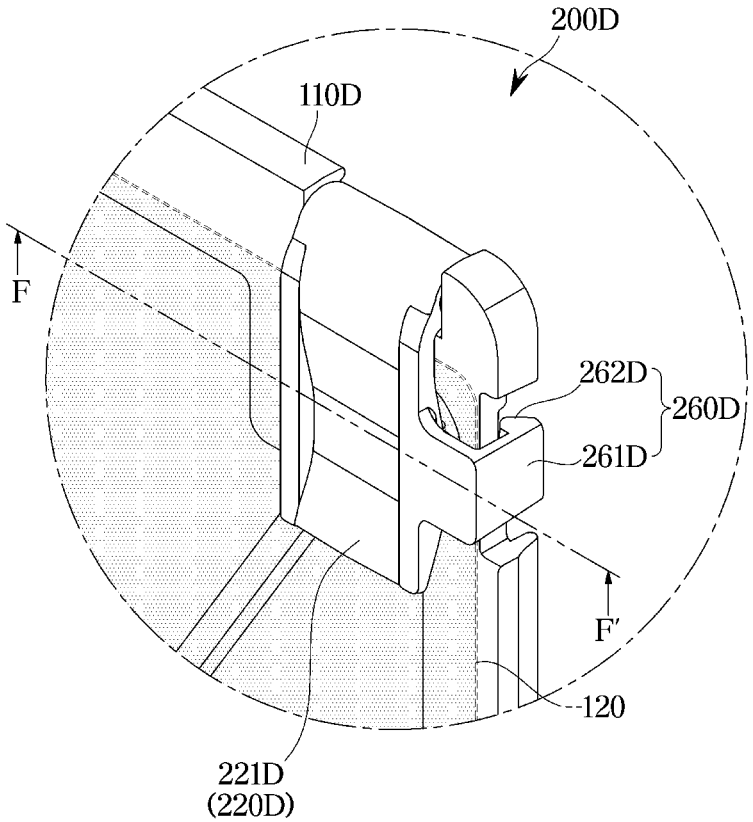
FIG. 20 is a view illustrating an auxiliary filter member coupled to a filter by a locking device according to still another embodiment of the disclosure.
Figure 21:
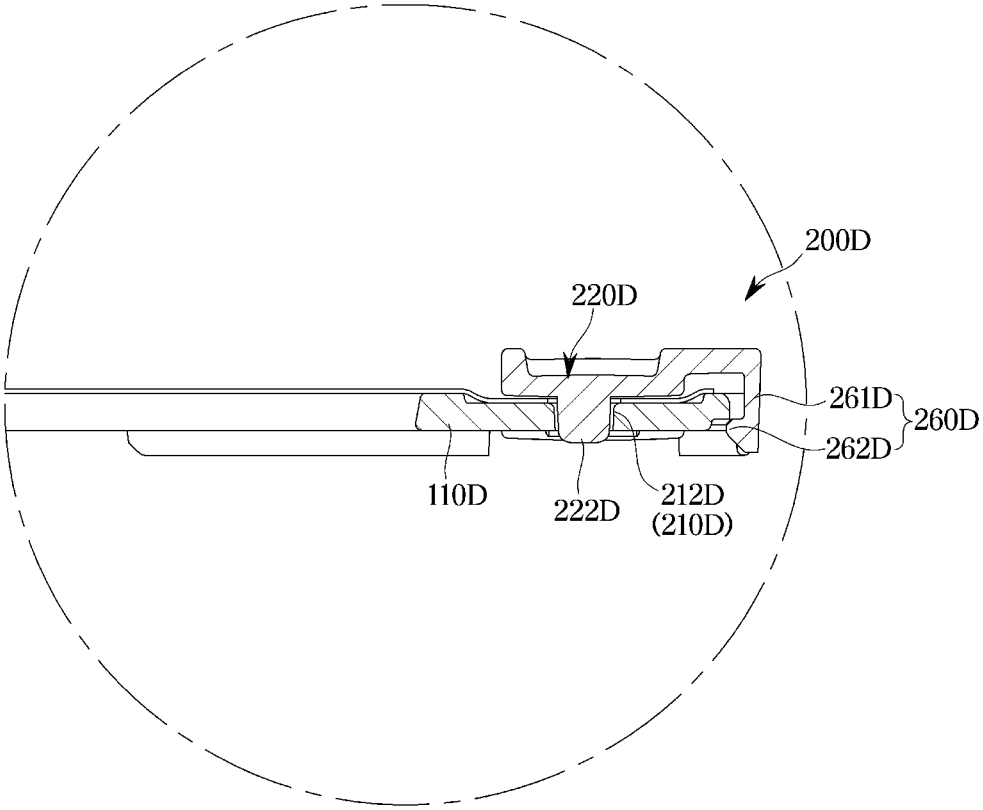
FIG. 21 is a cross-sectional view taken along line F-F' of FIG. 20, showing a locking device according to still another embodiment of the disclosure.

FIG. 19 is a perspective view illustrating a locking device according to still another embodiment of the disclosure, FIG. 20 is a view illustrating an auxiliary filter member coupled to a filter by a locking device according to still another embodiment of the disclosure, and FIG. 21 is a cross-sectional view taken along line F-F' of FIG. 20, showing a locking device according to still another embodiment of the disclosure. FIGS. 1 to 10 are referred to reference numerals of components not shown in the drawings.

Referring to FIGS. 19 to 21, the filter device 100 may include a filter 110D, an auxiliary filter member 120, and a locking device 200D provided to separably couple the filter 110D and the auxiliary filter member 120 to each other.

The locking device 200D may include a locking portion 210D provided on the filter 110D and a locking member 220D coupled to the locking portion 210D to lock or unlock the auxiliary filter member 120.

The locking portion 210D may be provided on the filter 110D. The locking portion 210D may include a plurality of protrusions 211D formed to protrude from the filter 110D. The plurality of protrusions 211D may be formed to have different heights. The plurality of protrusions 211D may be formed to have different thicknesses.

The locking portion 210D may include a first groove 212D formed as a recession in the filter 110D. The first groove 212D may be located at the center of the plurality of protrusions 211D.

The auxiliary filter member 120 may include a fastening hole 230 formed corresponding to the locking portion 210D to be locked to or unlocked from the filter 110 by the locking member 220D.

The locking member 220D may be rotatably coupled to the filter 110D. The locking member 220D is provided to be coupled to the locking portion 210D. The locking member 220D is provided to be coupled to the locking portion 210D to fix the auxiliary filter member 120 to the filter 110.

The locking member 220D may include a locking member body 221D. The locking member 220D may be rotatably provided on the filter 110D. A hinge portion 240D for hinge coupling between the locking member 220D and the filter 110D may be provided. The hinge portion 240D may include a hinge shaft 241D formed on the filter 110D and a hinge groove 242D formed in the locking member 220D.

The locking member body 221D may be coupled to the filter 110D to be rotatable on the hinge groove 242D. The locking member body 221D may be formed with a first protrusion 222D corresponding to the locking portion 210D. The locking member body 221D may be formed with the first protrusion 222D corresponding to the first groove 212D.

In this case, the first protrusion 222D of the locking member 220D is formed larger than the first groove 212D, so that the first protrusion 222D may be insertedly fixed to the first groove 212D in a force-fitting manner. The locking member 220D may be rotated on the hinge portion 240D. The first protrusion 222D of the locking member body 221D is inserted into the first groove 212D, so that the locking member 220D may be fixed to the filter 110D.

The locking member 220D may further include an extension portion 260D formed to extend to one side of the locking member body 221D to be coupled to the filter 110D. The extension portion 260D may be formed to extend outward of the locking member 220D. The extension portion 260D is provided to be coupled to at least a part of the filter 110D. The extension portion 260D may include an extension body 261D formed to extend from one side of the locking member body 221D and a hook 262D connected from the extension body 261D to be hooked with at least a portion of the filter 110D.

The locking member 220D may further include a support portion 250D provided to support coupling between the locking member 220D and the filter 110D. The support portion 250D may include a first support rib 251D formed on the locking member 220D and a second support rib 252D formed on the filter 110D to correspond to the first support rib 251D. The first support rib 251D is supported by the second support rib 252D of the filter 110D and provided to secure the coupling between the locking member 220D and the filter 110D.

In the embodiment of the disclosure, the locking member 220D is firmly fixed to the filter 110D by the support portion 250D, but the aspect of the disclosure is not limited thereto. For example, the configuration of the support portion may be omitted.

Hereinafter, a locking device 200E according to another embodiment of the disclosure will be described. The configuration of the filter device to be described below is the same as that of the air purifier 1 and the filter device according to the above-described embodiment, and thus details of redundant descriptions will be omitted.

Figure 22:
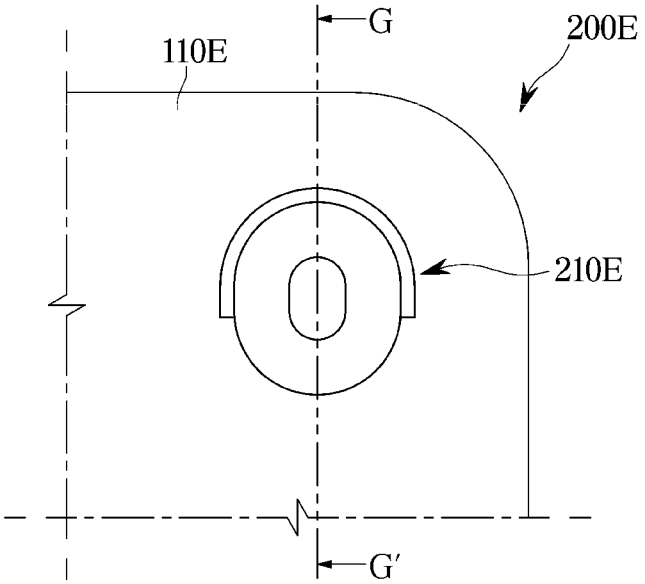
FIG. 22 is a view illustrating a locking portion of a locking device according to still another embodiment of the disclosure.
Figure 23:
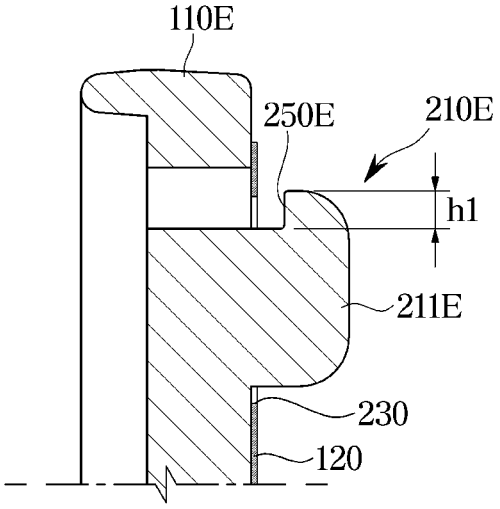
FIG. 23 is a cross-sectional view taken along line G-G' in FIG. 22.

FIG. 22 is a view illustrating a locking portion of a locking device according to still another embodiment of the disclosure, and FIG. 23 is a cross-sectional view taken along line G-G' in FIG. 22. FIGS. 1 to 10 are referred to reference numerals of components not shown in the drawings.

Referring to FIGS. 22 to 23, a locking portion 210E of the locking device 200E may be provided on a filter 110E.

The locking device 200E may include the locking portion 210E provided on the filter 110E. The locking portion 210E may be provided in four units thereof and the four locking portions 210E may be disposed at the corners of the filter 110E, respectively.

The locking portion 210E may include a locking protrusion 211E protruding from the filter 110E. The locking protrusion 211E may protrude in a direction opposite to the first direction X of the filter 110E. The locking protrusion 211E may be formed to protrude to the rear of the filter 110E. The locking protrusion 211E may be formed to protrude toward the auxiliary filter member 120 so as to be coupled to the auxiliary filter member 120. The locking portion 210E may be injection-molded integrally with the filter 110E. The locking protrusion 211E may be injection-molded integrally with the filter 110E.

The auxiliary filter member 120 may include a fastening hole 230 formed to be locked to or unlocked from the filter 110E by the locking portion 210E. The fastening hole 230 may be formed at a position corresponding to that of the locking protrusion 211E of the filter 110E.

The locking portion 210E may include a separation preventing portion 250E formed to prevent the fastening hole 230 of the auxiliary filter member 120 from being separated.

The separation preventing portion 250E may be formed to protrude outward of the locking protrusion 211E. The separation preventing portion 250E may be formed to protrude at a first height h1. The separation preventing portion 250E is formed to outwardly protrude at the first height h1 to prevent the fastening hole 230 of the auxiliary filter member 120 from being separated from the locking protrusion 211E.

Hereinafter, a locking device 200F of the filter device of the air purifier 1 according to another embodiment of the disclosure will be described. The configuration of the filter device to be described below is the same as that of the air purifier 1 and the filter device according to the above-described embodiment, and thus details of redundant descriptions will be omitted.

Figure 24:
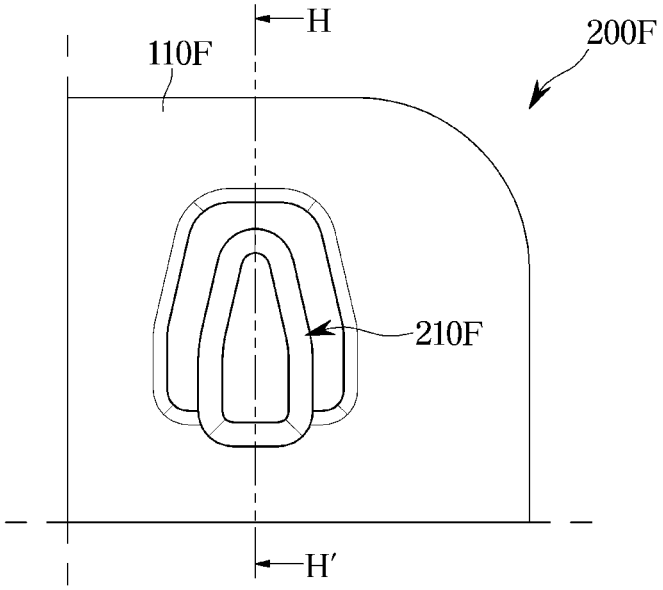
FIG. 24 is a view illustrating a locking portion of a locking device according to still another embodiment of the disclosure.
Figure 25:
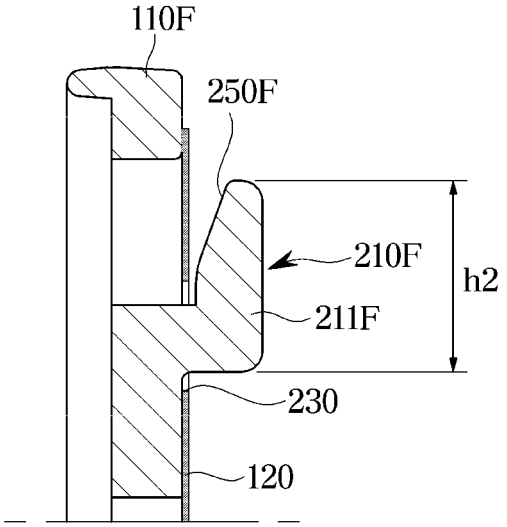
FIG. 25 is a cross-sectional view taken along line H-H' in FIG. 24.

FIG. 24 is a view illustrating a locking portion of a locking device according to still another embodiment of the disclosure, and FIG. 25 is a cross-sectional view taken along line H-H' in FIG. 24. FIGS. 1 to 10 are referred to reference numerals of components not shown in the drawings.

Referring to FIGS. 24 to 25, a locking portion 210F of the locking device 200F may be provided on a filter 110F.

The locking device 200F may include the locking portion 210F provided on the filter 110F. The locking portion 210F may be provided in four units thereof and the four locking portions 210F may be disposed at the corners of the filter 110F, respectively.

The locking portion 210F may include a locking protrusion 211F formed to protrude from the filter 110F. The locking protrusion 211F may protrude in a direction opposite to the first direction X of the filter 110F. The locking protrusion 211F may protrude to the rear of the filter 110F. The locking protrusion 211F may be formed to protrude toward the auxiliary filter member 120 so as to be coupled to the auxiliary filter member 120. The locking portion 210F may be injection-molded integrally with the filter 110F. The locking protrusion 211F may be injection-molded integrally with the filter 110F.

The auxiliary filter member 120 may include a fastening hole 230 formed to be locked to or unlocked from the filter 110F by the locking portion 210F. The fastening hole 230 may be formed at a position corresponding to that of the locking protrusion 211F of the filter 110F. The fastening hole 230 may be provided in four units thereof and may be disposed at the corners of the auxiliary filter member 120, respectively.

The locking portion 210F may include a separation preventing portion 250F formed to prevent the fastening hole 230 of the auxiliary filter member 120 from being separated.

The separation preventing portion 250F may be formed to protrude outward of the locking protrusion 211F. The separation preventing portion 250F may be formed to protrude at a second height h2. The second height h2 of the separation preventing portion 250F may be higher than the first height h1. The separation preventing portion 250F may be formed to outwardly protrude at the second height h2 to prevent the fastening hole 230 of the auxiliary filter member 120 from being separated from the locking protrusion 211F.

As is apparent from the above, the filter device of the air purifier according to the disclosure may allow easy attachment and detachment of a functional filter, so that when the functional filter is contaminated, the functional filter can be easily separated to be cleaned and replaced.

In addition, since the application and assembly of various functional filters are improved without an additional structure, maintenance and replacement costs for application and assembly of a functional filter can be reduced.

Although the air conditioner has been described by way of embodiments in relation to a specific shape and direction, the above embodiments are illustrative purpose only, and it would be appreciated by those skilled in the art that changes and modifications may be made in these embodiments without departing from the principles and scope of the disclosure, the scope of which is defined in the claims and their equivalents.

What is claimed is:

1. An air purifier comprising:

a main body:

a suction port to suction air into the main body therethrough;

a filter disposed in the main body to filter the air suctioned through the suction port, the filter including:

a frame; and a filter body fixed to the frame through which the suctioned air is filtered, the frame including a hinge shaft;

an auxiliary filter mountable to the filter; and a lock to mount the auxiliary filter to the frame of the filter, the lock including:

a first part of the lock formed at the frame of the filter; and a second part of the lock couplable to the first part of the lock, the second part of the lock including a hinge groove to be rotatably coupled to the hinge shaft by attaching the second part of the lock to the hinge shaft, or uncoupled from the hinge shaft by detaching the second part of the lock from the hinge shaft, wherein based on the hinge groove being rotatably coupled to the hinge shaft, by being pressed on the first part of the lock towards the second part of the lock, the second part of the lock is rotatable with respect to the hinge shaft and coupled to the first part of the lock thereby mounting the auxiliary filter to the filter, and by uncoupling the second part of the lock from the first part of the lock, the auxiliary filter is unmounted from the filter.

2. The air purifier of claim 1, wherein the auxiliary filter further includes a fastening hole formed therein to be used by the first part of the lock and the second part of the lock to mount the auxiliary filter to the filter or unmount the auxiliary filter from the filter.

3. The air purifier of claim 2, wherein the first part of the lock further includes a first groove formed as a recession in the frame of the filter, the second part of the lock includes a first protrusion corresponding to the first groove, and the fastening hole of the auxiliary filter is located between the first groove and the first protrusion so that the first protrusion penetrates the fastening hole and is inserted into the first groove to be coupled.

4. The air purifier of claim 2, wherein the second part of the lock further includes an extension part formed to extend outward from the second part of the lock to be coupled to at least a part of the filter.

5. The air purifier of claim 4, wherein the extension part further includes a hook to be hooked with the filter.

6. The air purifier of claim 2, wherein the first part of the lock further includes a separation preventing protrusion formed to protrude outward to prevent the first part of the lock from escaping from the fastening hole of the auxiliary filter.

7. The air purifier of claim 2, wherein one of the first part of the lock and the second part of the lock includes a locking protrusion and an other one of the first part of the lock and the second part of the lock includes a locking hole corresponding to the locking protrusion so that the locking protrusion penetrates the fastening hole of the auxiliary filter and then the locking hole and to be locked to the locking hole to mount the auxiliary filter to the filter.

8. The air purifier of claim 1, wherein one of the first part of the lock and the second part of the lock includes a locking protrusion, and an other one of the first part of the lock and the second part of the lock includes a locking hole corresponding to the locking protrusion so that the locking protrusion penetrates the locking hole and to be locked to the locking hole to mount the auxiliary filter to the filter.

9. The air purifier of claim 1, further comprising:

a first support rib formed on the second part of the lock; and a second support rib formed on the filter to correspond to the first support rib so that the first support rib is supported by the second support rib by contacting each other to secure the coupling of the second part of the lock and the first part of the lock.

10. The air purifier of claim 1, wherein the first part of the lock further includes a plurality of protrusions formed to protrude from the filter, and the auxiliary filter is arranged between the plurality of protrusions and the second part of the lock based on the second part of the lock being coupled to the first part of the lock.

11. The air purifier of claim 1, wherein the filter further includes a pre-filter and a dust collecting filter, and the auxiliary filter is arranged on one surface of at least one of the pre-filter and the dust collecting filter.

12. The air purifier of claim 1, wherein the auxiliary filter is formed of a mesh made from nylon and polyester.

13. The air purifier of claim 1, wherein the lock is arranged on each of four corners of the filter.

14. The air purifier of claim 1, wherein the second part of the lock is integrally formed with the filter.

* * * * *